US008903292B2

(12) United States Patent
Oohata

(10) Patent No.: US 8,903,292 B2
(45) Date of Patent: Dec. 2, 2014

(54) FIXING DEVICE AND IMAGE FORMING APPARATUS

(75) Inventor: Shinobu Oohata, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 162 days.

(21) Appl. No.: 13/355,200

(22) Filed: Jan. 20, 2012

(65) Prior Publication Data

US 2012/0189362 A1 Jul. 26, 2012

(30) Foreign Application Priority Data

Jan. 21, 2011 (JP) ..... 2011-011327
May 16, 2011 (JP) ..... 2011-109751

(51) Int. Cl.
*G03G 15/20* (2006.01)
*H05B 6/14* (2006.01)
*H05B 6/36* (2006.01)

(52) U.S. Cl.
CPC ..... *H05B 6/145* (2013.01); *G03G 15/2053* (2013.01); *H05B 6/365* (2013.01)
USPC ..... 399/328; 219/619

(58) Field of Classification Search
CPC ..... G03G 15/2053; G03G 2215/2003
USPC ..... 399/122, 328, 330, 331, 335, 336; 219/619
See application file for complete search history.

(56) References Cited

U.S. PATENT DOCUMENTS 7,425,691 B2 * 9/2008 Kinouchi et al. ..... 219/619
7,890,042 B2 * 2/2011 Ishida et al. ..... 399/329
8,050,611 B2 * 11/2011 Kinouchi et al. ..... 399/330
(Continued)

FOREIGN PATENT DOCUMENTS

| | | |
|---|---|---|
| JP | 2007-264021 | 10/2007 |
| JP | 2008-139434 A | 6/2008 |
| JP | 2010-002813 A | 1/2010 |
| JP | 2010-204265 A | 9/2010 |

OTHER PUBLICATIONS

Office Action mailed Jul. 2, 2013 in corresponding Japanese Patent Application No. 2011-109751.

*Primary Examiner* — David Gray
*Assistant Examiner* — Carla Therrien
(74) *Attorney, Agent, or Firm* — Knobbe Martens Olson & Bear LLP

(57) ABSTRACT

A fixing device includes: an induction coil; heating rotator; pressurizing rotator disposed to face the heating rotator; fixing nip; and magnetic core unit. The heating rotator is disposed in a region through which a magnetic flux generated by the induction coil passes and rotates about a first rotational shaft. The magnetic core unit forms a magnetic path circularly encloses the induction coil. The magnetic core unit includes arch core portions and a core supporting member supporting these portions. The arch core portions each have an arch shape facing the heating rotator across the induction coil and are arranged at intervals in a direction of the first rotational shaft. Each arch core portion has first engaging portions formed respectively at both ends thereof and a core main body formed between the first engaging portions. The core supporting member has second engaging portions with which the first engaging portions are engageable.

11 Claims, 15 Drawing Sheets

(56) References Cited

U.S. PATENT DOCUMENTS

| | | | | |
|---|---|---|---|---|
| 8,126,384 | B2 * | 2/2012 | Baba | 399/329 |
| 8,270,887 | B2 * | 9/2012 | Uchiyama et al. | 399/329 |
| 8,494,434 | B2 * | 7/2013 | Hase et al. | 399/406 |
| 2008/0267676 | A1 * | 10/2008 | Takai et al. | 399/335 |
| 2008/0302785 | A1 * | 12/2008 | Kinouchi et al. | 219/619 |
| 2009/0067903 | A1 * | 3/2009 | Yokoyama et al. | 399/330 |
| 2009/0101635 | A1 * | 4/2009 | Yokoyama et al. | 219/619 |
| 2010/0215414 | A1 * | 8/2010 | Uchiyama et al. | 399/329 |

* cited by examiner

FIXING DEVICE AND IMAGE FORMING APPARATUS

INCORPORATION BY REFERENCE

This application is based on and claims the benefit of priority from Japanese Patent Application Nos. 2011-011327 and 2011-109751, respectively filed on 21 Jan. 2011 and 16 May 2011, the contents of which are incorporated herein by reference.

BACKGROUND

The present disclosure relates to a fixing device and an image forming apparatus provided with the same.

Conventionally, as apparatuses for forming (printing) an image on paper as a recording medium, image forming apparatuses such as a copy machine, a printer, a facsimile machine, and a multi-functional peripheral having functions thereof have been known. In an image forming apparatus, processes described below sequentially perform: a charging step of charging a surface of a photoreceptor drum; an exposure step of forming an electrostatic latent image on the surface of the photoreceptor drum by causing laser light to emit on the charged surface of the photoreceptor drum; a development step that develops an image by depositing toner on the electrostatic latent image formed on the surface of the photoreceptor drum; an image transfer step that transfers a toner image formed of the toner deposited on the surface of the photoreceptor drum to the paper; and a fixation step that fixes the toner image transferred to the paper. An image is thus formed on the paper.

Among the abovementioned steps, in the fixation step, the toner needs to be heated and fused in order to fix the toner composing the toner image transferred to the paper. As a fixing device that performs the fixation step, a fixing device has been conventionally used, which includes: a heating rotator; a pressurizing rotator that nips the paper on which the toner image is transferred to form a fixing nip with the heating rotator; and a heater such as a halogen lamp for heating the heating rotator.

As a method of heating a heating rotator of a fixing device, heating a heating rotator by Induction Heating (IH) using electromagnetic induction has been recently used, in addition to a method of heating by a halogen lamp. In the induction heating (IH) method, the fixing device is provided with: an induction coil that generates a magnetic flux by an applied current; a heating rotator that is disposed in a region through which the magnetic flux generated by the induction coil passes; a pressurizing rotator that is disposed to face the heating rotator; and a magnetic core unit configured to form a magnetic path passing inside an inner peripheral edge and outside an outer peripheral edge of the induction coil such that the magnetic path circularly encloses the induction coil. The magnetic core unit includes, for example, a plurality of arch core portions and a core supporting member that supports the arch core portions. The arch core portions have an arch shape facing an outer surface of the heating rotator with the induction coil being interposed therebetween. The fixing device employing the induction heating (IH) method has advantages of more rapid heating and higher heating efficiency over the fixing device employing the heating method using a halogen lamp.

In such a fixing device, an amount of heat generated by the heating rotator is proportional to an amount of magnetic flux passing through the heating rotator. The amount of magnetic flux passing through the heating rotator varies according to positional relationships of the induction coil and the arch core portions of the magnetic core unit with respect to the heating rotator.

Given this, when a distance between the heating rotator and the induction coil, and a distance between the heating rotator and the arch core portions are not constant, the heating rotator may not be able to generate a predetermined amount of heat.

On the other hand, it is not easy to ensure dimensional accuracy of the arch core portions due to the difficulty related to a manufacturing technique and it may be likely that a dimensional error often occurs. In order to absorb the dimensional error, special support equipment has been used for assembling (fixing) the core supporting member and the arch core portions, or a gap has been provided between the core supporting member and the arch core portions and filled with an adhesive for bonding the core supporting member and the arch core portions. Accordingly, it has not been easy to assemble (fix) the core supporting member and the arch core portions.

SUMMARY

The present disclosure is aimed at providing a fixing device allowing easy assembly of a core supporting member and arch core portions of a magnetic core unit.

In addition, the present disclosure is aimed at providing an image forming apparatus provided with the fixing device described above.

In an aspect of the present disclosure, a fixing device is provided, which includes: an induction coil; a heating rotator; a pressurizing rotator; a fixing nip; and a magnetic core unit. The induction coil is configured to generate a magnetic flux. The heating rotator is disposed in a region through which the magnetic flux generated by the induction coil passes, and configured to rotate about a first rotational shaft. The pressurizing rotator is disposed to face the heating rotator. The fixing nip is formed between the heating rotator and the pressurizing rotator, where a recording medium is nipped and conveyed. The magnetic core unit is configured to form a magnetic path passing inside an inner peripheral edge and outside an outer peripheral edge of the induction coil such that the magnetic path circularly encloses the induction coil. The magnetic core unit includes a plurality of arch core portions and a core supporting member supporting the arch core portions. The arch core portions each have an arch shape facing an outer surface of the heating rotator with the induction coil being interposed therebetween and are arranged at intervals in a direction of the first rotational shaft. Each of the arch core portions has first engaging portions formed respectively at both ends thereof and a core main body formed between the first engaging portions. The core supporting member has second engaging portions with which the first engaging portions are engageable.

In another aspect of the present disclosure, an image forming apparatus is provided, which includes: an image bearing member; a development unit; an image transfer portion; and a fixing device. On a surface of the image bearing member an electrostatic latent image is formed. The development unit is configured to develop the electrostatic image formed on the surface of the image bearing member as a toner image. The image transfer portion is configured to transfer the toner image formed on the surface of the image bearing member directly or indirectly to a recording medium. The fixing device is configured to fix the toner image onto the recording medium. The fixing device includes: an induction coil; a heating rotator; a pressurizing rotator; a fixing nip; and a magnetic core unit. The induction coil is configured to generate a magnetic flux. The heating rotator is disposed in a region through which the magnetic flux generated by the induction coil passes, and configured to rotate about a first rotational shaft. The pressurizing rotator is disposed to face the heating rotator. The fixing nip is formed between the heating rotator and the pressurizing rotator, where the recording medium is nipped and conveyed. The magnetic core unit is configured to form a magnetic path passing inside an inner peripheral edge and outside an outer peripheral edge of the induction coil such that the magnetic path circularly encloses the induction coil. The magnetic core unit includes a plurality of arch core portions and a core supporting member supporting the arch core portions. The arch core portions each have an arch shape facing an outer surface of the heating rotator with the induction coil being interposed therebetween and are arranged at intervals in a direction of the first rotational shaft. Each of the arch core portions has first engaging portions formed respectively at both ends thereof and a core main body formed between the first engaging portions. The core supporting member has second engaging portions with which the first engaging portions are engageable.

DETAILED DESCRIPTION

Figure 1:
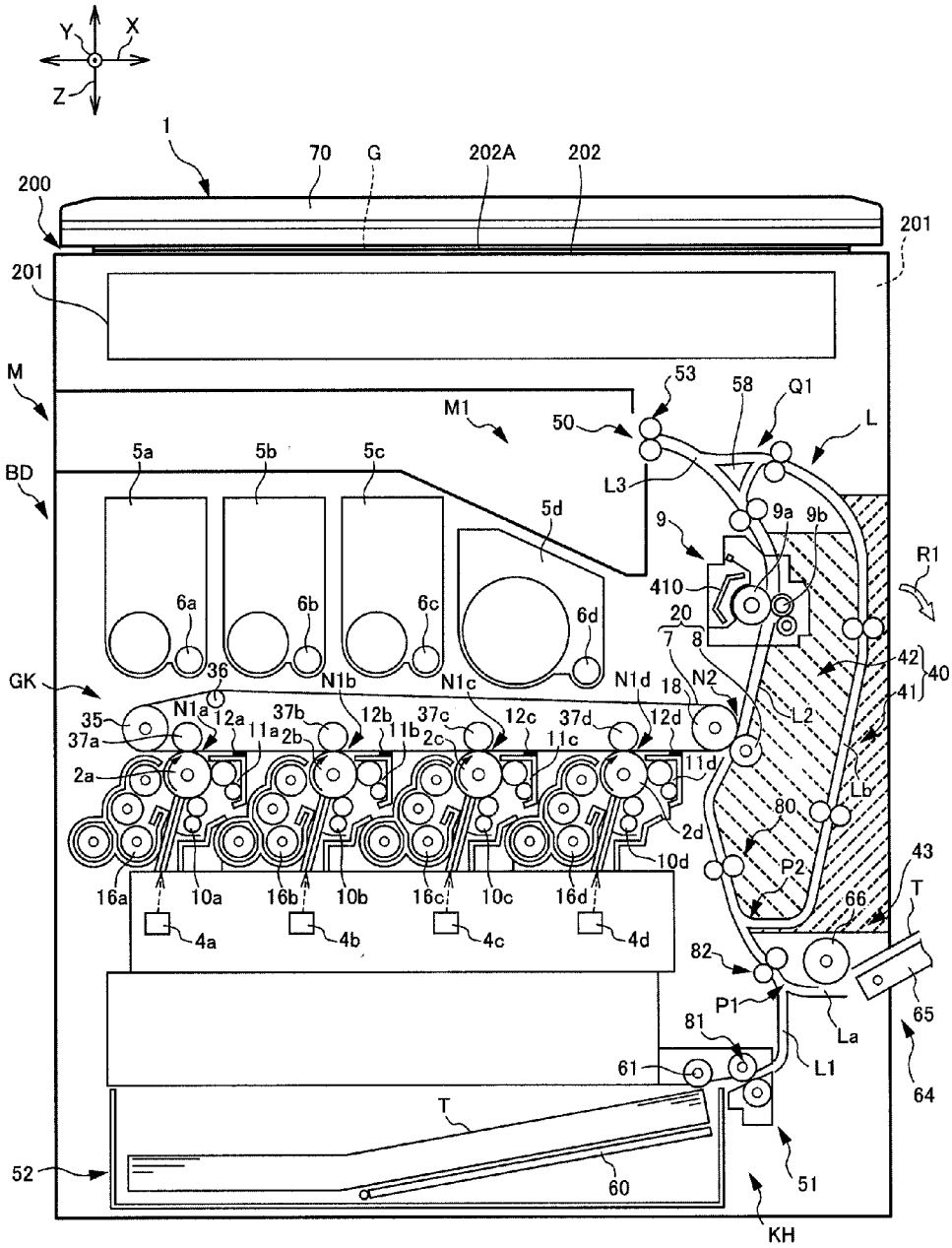
FIG. 1 is a front view illustrating arrangement of components of a copy machine according to a first embodiment of the present disclosure.

Embodiments of the present disclosure are described hereinafter with reference to the drawings. An overall structure of a copy machine 1 as an embodiment of an image forming apparatus according to the present disclosure is described referring to FIG. 1. FIG. 1 is a front view illustrating arrangement of components of a copy machine 1 according to a first embodiment of the present disclosure.

Hereinafter, when viewed by a user standing in front of the copy machine 1, a left-right direction is defined as a direction of arrow X, a depth direction is defined as a direction of arrow Y, and a vertical direction is defined as a direction of arrow Z. The left-right direction X coincides with a sub-scanning direction. The depth direction Y coincides with a main scanning direction.

As shown in FIG. 1, the copy machine 1 as the image forming apparatus includes: an image reading device 200 disposed at an upper portion in the vertical direction Z; and a device main body M disposed at a lower portion in the vertical direction Z that forms a toner image on a sheet of paper T, as a recording medium, based on image information from the image reading device 200.

The image reading device 200 includes a flap member 70 and a reading unit 201 that reads an image from an original G. The flap member 70 is connected openably and closably with the reading unit 201 through a connecting portion (not shown). The flap member 70 functionally protects a reading surface 202A (described later).

The reading unit 201 includes the reading surface 202A, a carriage (not illustrated) that is disposed inside the reading unit 201 and moves in a direction parallel to the reading surface 202A, a plurality of mirrors forming light paths (not illustrated), an imaging lens (not illustrated), a CCD (not illustrated) as reading means, and a CCD board (not illustrated). The CCD board performs a predetermined process with respect to image data read by the CCD and outputs the image data to the apparatus main body M. The reading surface 202A is formed along an upper face of a contact glass 202 on which the original G is placed.

The carriage is provided with the plurality of mirrors forming the light paths. The carriage is moved at a constant speed in the sub-scanning direction X. In this manner, an image of the original G placed on the reading surface 202A is read by the reading unit 201.

The apparatus main body M includes: an image forming unit GK that forms an image on a sheet of paper T based on image information; and a paper feeding/discharging unit KH that feeds the sheet of paper T to the image forming unit GK and discharges the sheet of paper T on which an image is formed. The outer shape of the apparatus main body M is configured by a casing BD as a housing.

As shown in FIG. 1, the image forming unit GK includes: photoreceptor drums 2*a*, 2*b*, 2*c*, and 2*d* as image bearing member (photoreceptors); charging units 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding units 6*a*, 6*b*, 6*c*, and 6*d*; drum cleaning units 11*a*, 11*b*, 11*c*, and 11*d*; neutralization devices 12*a*, 12*b*, 12*c*, and 12*d*; a transfer unit 20; and a fixing device 9. The transfer unit 20 includes: an intermediate transfer belt 7; primary transfer rollers 37*a*, 37*b*, 37*c*, and 37*d*; a secondary transfer roller 8; and an opposing roller 18. Primary transfer nips N1*a*, N1*b*, N1*c*, and N1*d* are formed between the photoreceptor drums 2*a*, 2*b*, 2*c*, and 2*d* and the primary transfer rollers 37*a*, 37*b*, 37*c*, and 37*d*, respectively. A secondary transfer nip N2 is formed between the secondary transfer roller 8 and the opposing roller 18 (the intermediate transfer belt 7).

As shown in FIG. 1, the paper feeding/discharging unit KH includes a paper feeding cassette 52, a manual feeding portion 64, a paper feeding path L for a sheet of paper T, a pair of registration rollers 80, a plurality of rollers or roller pairs, and a discharging portion 50. As described later, the paper feeding path L is made up of a first paper feeding path L1, a second paper feeding path L2, a third paper feeding path L3, a manual paper feeding path La, and a reverse paper feeding path Lb.

Components of the image forming unit GK and the paper feeding/discharging unit KH will be described in detail hereinafter. First, a description is provided for the image forming unit GK.

In the image forming unit GK, charging by the charging parts 10*a*, 10*b*, 10*c* and 10*d*, exposure by the laser scanner units 4*a*, 4*b*, 4*c* and 4*d*, development by the developing units 16*a*, 16*b*, 16*c* and 16*d*, primary transfer at the primary transfer nips N1*a*, Nib, N1*c*, and N1*d*, neutralization by the neutralization devices 12*a*, 12*b*, 12*c* and 12*d*, and cleaning by the drum cleaning units 11*a*, 11*b*, 11*c* and 11*d*, are performed on a surface of each of the photoreceptor drums 2*a*, 2*b*, 2*c* and 2*d*, sequentially from upstream to downstream in a rotational direction. In addition, secondary transfer at the secondary transfer nip N2 and fixation by the fixing device 9 are performed in the image forming unit GK.

The primary transfer is a process of transferring a toner image formed on each of the photoreceptor drums 2*a*, 2*b*, 2*c* and 2*d* onto the intermediate transfer belt 7, by the intermediate transfer belt 7 and the primary transfer rollers 37*a*, 37*b*, 37*c* and 37*d* constituting the transfer unit 20. The secondary transfer is a process of transferring the toner image primarily transferred to the intermediate transfer belt 7 to a sheet of paper T, by the intermediate transfer belt 7, the secondary transfer roller 8 and the opposing roller 18 constituting the transfer unit 20.

Each of the photoreceptor drums 2*a*, 2*b*, 2*c*, and 2*d* is composed of a cylindrically shaped member and functions as a photoreceptor or an image bearing member. Each of the photoreceptor drums 2*a*, 2*b*, 2*c* and 2*d* is configured to be rotatable about an axis extending in a direction orthogonal to the direction of the movement of the intermediate transfer belt 7, in the direction of an arrow illustrated in FIG. 1. An electrostatic latent image can be formed on a surface of each of the photoreceptor drums 2*a*, 2*b*, 2*c* and 2*d*.

Each of the charging units 10*a*, 10*b*, 10*c* and 10*d* is arranged opposite to the surface of each of the photoreceptor drums 2*a*, 2*b*, 2*c* and 2*d*. Each of the charging units 10*a*, 10*b*, 10*c* and 10*d* positively charges (positive polarity) or negatively charges (negative polarity) the surface of each of the photoreceptor drums 2*a*, 2*b*, 2*c* and 2*d* in a uniform manner.

The laser scanner units 4*a*, 4*b*, 4*c* and 4*d* function as exposure units, and are respectively separated from the surface of each of the photoreceptor drums 2*a*, 2*b*, 2*c* and 2*d*. The laser scanner units 4*a*, 4*b*, 4*c* and 4*d* each include a laser light source, a polygonal mirror, a polygonal mirror driving motor and the like, which are not illustrated.

The laser scanner units 4*a*, 4*b*, 4*c* and 4*d* scan and expose surfaces of the photoreceptor drums 2*a*, 2*b*, 2*c* and 2*d* respectively, based on the image information that is input by the reading unit 201. An electric charge of an exposed portion of the surface of each of the photoreceptor drums 2*a*, 2*b*, 2*c*, and 2*d* is removed, which are scanned and exposed by the laser scanner units 4*a*, 4*b*, 4*c*, and 4*d*, respectively. In this manner, an electrostatic latent image is formed on the surface of each of the photoreceptor drums 2*a*, 2*b*, 2*c* and 2*d*.

The developing units 16*a*, 16*b*, 16*c*, and 16*d* are disposed corresponding to the photoreceptor drums 2*a*, 2*b*, 2*c*, and 2*d*, respectively, facing corresponding surfaces of the photoreceptor drums 2*a*, 2*b*, 2*c*, and 2*d*. Each of the developing units 16*a*, 16*b*, 16*c* and 16*d* causes toner of each color to adhere to the electrostatic latent image formed on the surface of each of the photoreceptor drums 2*a*, 2*b*, 2*c* and 2*d*, thereby forming a toner image of each color on the surface of each of the photoreceptor drums 2*a*, 2*b*, 2*c* and 2*d*. The developing units 16*a*, 16*b*, 16*c* and 16*d* correspond to four colors, yellow, cyan, magenta, and black, respectively. Each of the developing units 16*a*, 16*b*, 16*c* and 16*d* includes a developing roller (not illustrated) arranged to face the surface of each of the photoreceptor drums 2*a*, 2*b*, 2*c* and 2*d*, an agitation roller for agitating the toner, and the like.

The toner cartridges 5*a*, 5*b*, 5*c* and 5*d* are provided corresponding to the developing units 16*a*, 16*b*, 16*c* and 16*d*, respectively, and store the toner of each color to be supplied for each of the developing units 16*a*, 16*b*, 16*c* and 16*d*. The toner cartridges 5*a*, 5*b*, 5*c* and 5*d* store yellow toner, cyan toner, magenta toner, and black toner, respectively.

The toner feeding units 6*a*, 6*b*, 6*c*, and 6*d* are provided corresponding to the toner cartridges 5*a*, 5*b*, 5*c*, and 5*d* and the developing units 16*a*, 16*b*, 16*c*, and 16*d*, respectively. Each of the toner supply units 6*a*, 6*b*, 6*c* and 6*d* supplies the toner of each color stored in each of the toner cartridges 5*a*, 5*b*, 5*c* and 5*d* to each of the developing units 16*a*, 16*b*, 16*c* and 16*d*. The toner feeding parts 6*a*, 6*b*, 6*c*, and 6*d* are connected with the developing units 16*a*, 16*b*, 16*c*, and 16*d*, respectively, via toner feeding paths (not illustrated).

Toner images of respective colors formed on the photoreceptor drums 2*a*, 2*b*, 2*c*, and 2*d* undergo primary transfer in sequence onto the intermediate transfer belt 7. The intermediate transfer belt 7 is stretched around a driven roller 35, the opposing roller 18 as a driving roller, a tension roller 36 and the like. Since the tension roller 36 biases the intermediate transfer belt 7 from inside to outside, a predetermined tension is applied to the intermediate transfer belt 7.

Each of the primary transfer rollers 37*a*, 37*b*, 37*c* and 37*d*, is arranged opposite to each of the photoreceptor drums 2*a*, 2*b*, 2*c* and 2*d* across the intermediate transfer belt 7.

The intermediate transfer belt 7 is sandwiched between each of the primary transfer rollers 37*a*, 37*b*, 37*c* and 37*d* and each of the photoreceptor drums 2*a*, 2*b*, 2*c* and 2*d*. A sandwiched portion of the intermediate transfer belt 7 is pressed against the respective surfaces of the photoreceptor drums 2*a*, 2*b*, 2*c* and 2*d*.

At the primary transfer nips N1*a*, N1*b*, N1*c* and N1*d*, toner images of respective colors formed on the photoreceptor drums 2*a*, 2*b*, 2*c* and 2*d* are sequentially primarily transferred to the intermediate transfer belt 7. In this manner, a full-color toner image is formed on the intermediate transfer belt 7.

A primary transfer bias is applied to each of the primary-transfer rollers 37*a*, 37*b*, 37*c*, and 37*d* by a primary transfer bias application portion (not illustrated). The primary transfer bias is a bias for transferring the toner images of the colors formed respectively on the photoreceptor drums 2*a*, 2*b*, 2*c*, and 2*d* to the intermediate transfer belt 7.

Each of the neutralization devices 12*a*, 12*b*, 12*c* and 12*d* is arranged opposite to the surface of each of the photoreceptor drums 2*a*, 2*b*, 2*c* and 2*d*. The neutralization devices 12*a*, 12*b*, 12*c*, and 12*d* each remove electricity (eliminate an electrical charge) from the surface of each of the photoreceptor drums 2*a*, 2*b*, 2*c*, and 2*d* after the primary transfer, by casting light on the surface of each of the photoreceptor drums 2*a*, 2*b*, 2*c*, and 2*d*.

Each of the drum cleaning units 11*a*, 11*b*, 11*c* and 11*d* is arranged opposite to the surface of each of the photoreceptor drums 2*a*, 2*b*, 2*c* and 2*d*. The drum cleaning units 11*a*, 11*b*, 11*c*, and 11*d* remove toner and attached matter remaining on the surface of the photoreceptor drums 2*a*, 2*b*, 2*c*, and 2*d* after the primary transfer, respectively, and cause the removed toner to be carried to a predetermined collection mechanism.

The secondary transfer roller 8 causes the full-color toner image, which has been primarily transferred to the intermediate transfer belt 7, to be secondarily transferred to a sheet of paper T. A secondary transfer bias is applied to the secondary transfer roller 8, by a secondary transfer bias application unit (not illustrated). The secondary transfer bias is a bias for transferring the full-color toner image formed on the intermediate transfer belt 7 to the sheet of paper T.

The secondary transfer roller 8 comes into contact with and departs away from the intermediate transfer belt 7 selectively. More specifically, the secondary transfer roller 8 is configured to be movable between a contact position in contact with the intermediate transfer belt 7 and a separate position separated from the intermediate transfer belt 7. In particular, the secondary transfer roller 8 is positioned at the contact position when it transfers the toner image that has been primarily transferred to the surface of the intermediate transfer belt 7 onto the sheet of paper T. Under other circumstances it is positioned at the separate position.

The opposing roller 18 is arranged opposite the secondary transfer roller 8 relative to the intermediate transfer belt 7. The intermediate transfer belt 7 is sandwiched between the secondary-transfer roller 8 and the opposing roller 18. The sheet of paper T is pressed against an outer surface (a surface to which the toner image is primarily transferred) of the intermediate transfer belt 7. At the secondary transfer nip N2, the full-color toner image primarily transferred to the intermediate transfer belt 7 is secondarily transferred to the sheet of paper T.

The fixing device 9 fuses and pressurizes color toners constituting the toner image secondarily transferred to the sheet of paper T, in order to fix the color toners on the sheet of paper T. The fixing device 9 includes a heating rotator 9*a* that generates heat by the action of a magnetic flux generated by an external magnetic flux generation mechanism 410 (described later), and a pressurizing rotator 9*b*. The heating rotator 9*a* and the pressurizing rotator 9*b* sandwich and apply pressure to the sheet of paper T to which the toner image is secondarily transferred, and also feed the sheet of paper T. The paper T is fed while being sandwiched between the heating rotator 9*a* and the pressurizing rotator 9*b*, and the toner transferred to the sheet of paper T is fused, applied pressure and fixed. A configuration of the fixing device 9 is described later in detail.

Next, the paper feeding/discharging unit KH will be described. As shown in FIG. 1, the paper feeding cassette 52 for accommodating sheets of paper T is disposed in a lower portion of the apparatus main body M. The paper feeding cassette 52 is slidable in a horizontal direction from the casing BD of the apparatus main body M. The paper feeding cassette 52 includes a paper tray 60 on which the sheets of paper T are placed. The paper feeding cassette 52 stores the sheets of paper T stacked on the paper tray 60. A sheet of paper T placed on the paper tray 60 is fed to the paper feeding path L by a cassette feeding portion 51 disposed in an end portion of the paper feeding cassette 52 on a side of feeding the paper (in a right end part of FIG. 1). The cassette feeding portion 51 includes a double feed prevention mechanism composed of: a forward feed roller 61 for picking up the sheets of paper T on the paper tray 60; and a pair of paper feeding rollers 81 for feeding the sheets of paper T one sheet at a time to the paper feeding path L.

The manual feeding portion 64 is provided on a right lateral face (the right side in FIG. 1) of the apparatus main body M. The manual feeding portion 64 is provided in order to feed other sheets of paper T to the apparatus main body M, which are different in size and type from the sheets of paper T stored in the paper feeding cassette 52. The manual feeding unit 64 includes a manual feeding tray 65, which becomes a portion of the right lateral face of the apparatus main body M when the manual feeding portion 64 is closed, and a paper feeding roller 66. A lower end of the manual feeding tray 65 is attached to the casing body BD, in the vicinity of the paper feeding roller 66, so as to be rotatable (openable and closable). A sheet or sheets of paper T are placed on the manual feeding tray 65 while it is open. The paper feeding roller 66 feeds a sheet of paper T placed on the manual feeding tray 65 in an opened state to the manual feeding path La.

The paper feeding path L includes: a first paper feeding path L1 from the cassette feeding portion 51 to the secondary transfer nip N2; a second paper feeding path L2 from the secondary transfer nip N2 to the fixing device 9; a third paper feeding path L3 from the fixing device 9 to the discharging portion 50; the manual paper feeding path La that guides paper fed from the manual feeding portion 64 to the first paper feeding path L1; and a reverse paper feeding path Lb that returns a sheet of paper T that is fed from downstream to upstream in the third paper feeding path L3 to the first paper feeding path L1 such that the sheet of paper T is turned upside down.

In addition, a first junction P1 and a second junction P2 are provided midway in the first paper feeding path L1. A first branch portion Q1 is provided midway in the third paper feeding path L3. The first junction P1 is a junction where the manual paper feeding path La joins the first paper feeding path L1. The second junction P2 is a junction where the reverse paper feeding path Lb joins the first paper feeding path L1. The first branch portion Q1 is a branch portion where the reverse paper feeding path Lb branches off from the third paper feeding path L3.

A paper detection sensor (not illustrated) for detecting a sheet of paper T and the pair of registration rollers 80 are disposed midway in the first paper feeding path L1 (more specifically, between the second junction P2 and the secondary transfer nip N2). The paper detection sensor is disposed immediately before the pair of registration rollers 80 in a feed direction of the sheet of paper T (upstream in the feed direction). The pair of registration rollers 80 is designed for skew correction of the sheet of paper T and timing adjustment of feeding the sheet of paper T in the first paper feeding path L1 with respect to formation of the toner image in the image forming unit GK. The pair of registration rollers 80 feeds the sheet of paper T toward the first paper feeding path L1 while performing the abovementioned correction and timing adjustment based on detection information from the paper detection sensor.

A pair of intermediate rollers 82 is disposed between the first junction P1 and the second junction P2 in the first paper feeding path L1. The pair of intermediate rollers 82 is disposed downstream in the paper feed direction with respect to the pair of paper feeding rollers 81, and pinches and feeds the sheet of paper T, which is fed from the pair of paper feeding rollers 81, to the pair of registration rollers 80.

A return paper feeding path Lb is for causing a surface (an unprinted surface) opposite to a surface having already been printed to face the intermediate transfer belt 7, when duplex printing of a sheet of paper T is performed. The reverse paper feeding path Lb is for turning the sheet of paper T upside down, conveyed from the first branch portion Q1 toward the discharging portion 50, to the first paper feeding path L1, in order to convey the sheet of paper T to upstream of the pair of registration rollers 80 disposed upstream of the secondary transfer nip N2. At the secondary transfer nip N2, a toner image is transferred to the unprinted surface of the sheet of paper T that has been reversed by the return paper feeding path Lb.

A regulating member 58 is provided in the first branch portion Q1. The regulating member 58 regulates a feed direction of the sheet of paper T, which is fed out from the fixing device 9 and fed from upstream to downstream of the third paper feeding path L3, to a direction toward the discharging portion 50. The regulating member 58 regulates a feed direction of the sheet of paper T, which is fed from the discharging portion 50 from downstream to upstream of the third paper feeding path L3, to a direction toward the reverse paper feeding path Lb.

The discharging portion 50 is formed at an end portion of the third paper feeding path L3. The discharging portion 50 is disposed at an upper portion of the apparatus main body M. The discharging portion 50 has an opening toward a left lateral face of the apparatus main body M (left side in FIG. 1). The discharging portion 50 ejects the sheet of paper T to the outside of the apparatus main body M. The discharging portion 50 includes a pair of discharging rollers 53. With the pair of discharging rollers 53, the sheet of paper T, which is fed from upstream to downstream of the third paper feeding path L3, can be discharged outside the apparatus main body M; and the sheet of paper T can be fed toward upstream of the third paper feeding path L3 by reversing the feed direction of the sheet of paper T at the discharging portion 50.

A discharged paper accumulating portion M1 is formed adjacent to the opening of the discharging portion 50. The discharged paper accumulating portion M1 is formed on an upper face (outer face) of the apparatus main body M. The discharged paper accumulating portion M1 is a portion of the upper face of the apparatus main body M formed to be depressed downward. A bottom face of the discharged paper accumulating portion M1 composes a portion of the upper face of the apparatus main body M. Sheets of paper T, on which toner images are formed and which are discharged from the discharging portion 50, are stacked and collected in the discharged paper accumulating portion M1. It should be noted that a sensor for detecting a recording medium is disposed at a predetermined position in each paper feeding path.

Next, a structure for eliminating paper jams in main paper feeding paths L1 to L3 (the first paper feeding path L1, the second paper feeding path L2, and the third paper feeding path L3 are also collectively referred to as "main paper feeding paths" hereinafter) and in the reverse paper feeding path Lb is briefly described. As shown in FIG. 1, on a right lateral face side of the apparatus main body M (right side in FIG. 1), the first to third paper feeding paths L1 to L3 and the reverse paper feeding path Lb extend in parallel substantially in a vertical direction. On the right lateral face side of the apparatus main body M (right side in FIG. 1), a cover unit 40 is provided so as to constitute a portion of the lateral face of the apparatus main body M. A lower end portion of the cover unit 40 is connected with the apparatus main body M via a fulcrum shaft 43. The fulcrum shaft 43 is disposed such that an axial direction thereof is along a direction intersecting the main paper feeding paths L1 to L3 and the reverse paper feeding path Lb (the direction Y). The cover unit 40 is rotatable about the fulcrum shaft 43 between a closed position (shown in FIG. 1) and an opened position (a position after rotation in a direction of an arrow R1 of FIG. 1).

The cover unit 40 is composed of a first cover portion 41 connected pivotably with the apparatus main body M by the fulcrum shaft 43 and a second cover portion 42 connected pivotably with the apparatus main body M by the same fulcrum shaft 43. The first cover portion 41 is positioned more externally than the second cover portion 42 with respect to an external side (lateral face side) of the apparatus main body M. It should be noted that, in FIG. 1, the first cover portion 41 is a part hatched with falling diagonal broken lines from top right to bottom left, and the second cover portion 42 is a part hatched with falling diagonal broken lines from top left to bottom right.

When the cover unit 40 is in the closed position, an outer face of the first cover portion 41 constitutes a portion of an outer face (lateral face) of the apparatus main body M. In addition, when the cover unit 40 is in the closed position, an inner face (facing inside the apparatus main body M) of the second cover portion 42 constitutes a portion of the main paper feeding paths L1 to L3. Furthermore, when the cover unit 40 is in the closed position, an inner face of the first cover portion 41 and an outer face of the second cover portion 42 constitute at least a portion of the reverse paper feeding path Lb. In other words, the reverse paper feeding path Lb is formed between the first cover portion 41 and the second cover portion 42.

Since the copy machine 1 according to the present embodiment is provided with the cover unit 40 configured as described above, it is possible to remove a jammed sheet of paper T in the first to third paper feeding paths L1 to L3 by rotating the cover unit 40 from the closed position shown in FIG. 1 to the opened position not illustrated so as to open the first to third paper feeding paths L1 to L3, when a paper jam occurs in the first to third paper feeding paths L1 to L3. On the other hand, when a paper jam occurs in the reverse paper feeding path Lb, it is possible to remove a jammed sheet of paper T in the reverse paper feeding path Lb by rotating the cover unit 40 to the opened position and subsequently rotating the second cover portion 42 about the fulcrum shaft 43 toward the apparatus main body M (left side in FIG. 1) so as to open the reverse paper feeding path Lb.

In summary, the abovementioned copy machine 1 includes: the photoreceptor drums 2*a* to 2*d* as at least one image supporting body on a surface of which an electrostatic latent image is formed; the developing units 16*a*, 16*b*, 16*c* and 16*d* that develops the electrostatic latent image formed on at least one of the photoreceptor drums 2*a* to 2*d* to a toner image; the transfer unit 20 that transfers the toner image formed on the photoreceptor drums 2*a* to 2*d* directly or indirectly to the sheet of paper T as the recording medium; and the fixing device 9 to be described later.

First Embodiment

Figure 2:
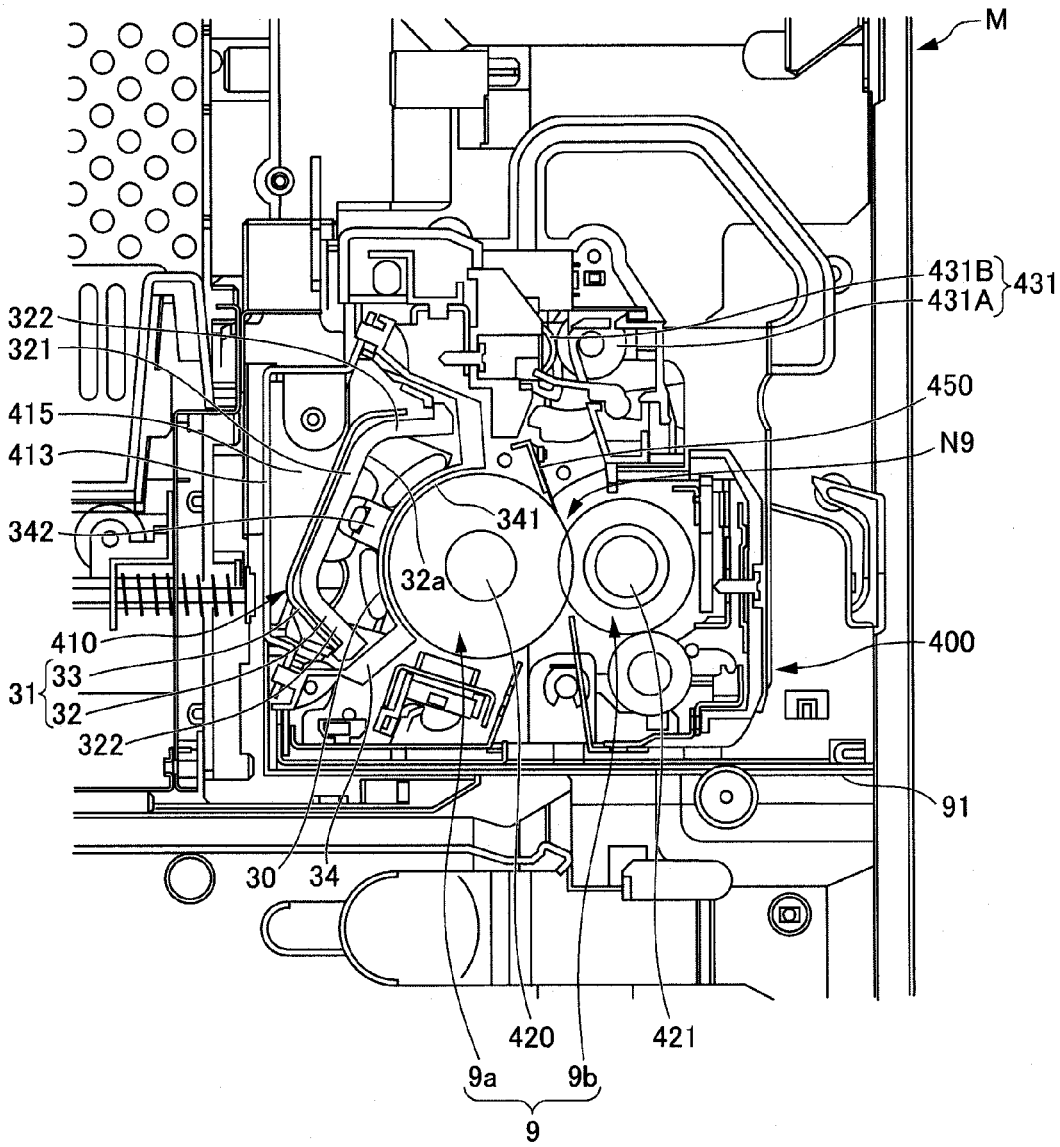
FIG. 2 is an enlarged view of a fixing device of the first embodiment illustrated in FIG. 1.
Figure 3:
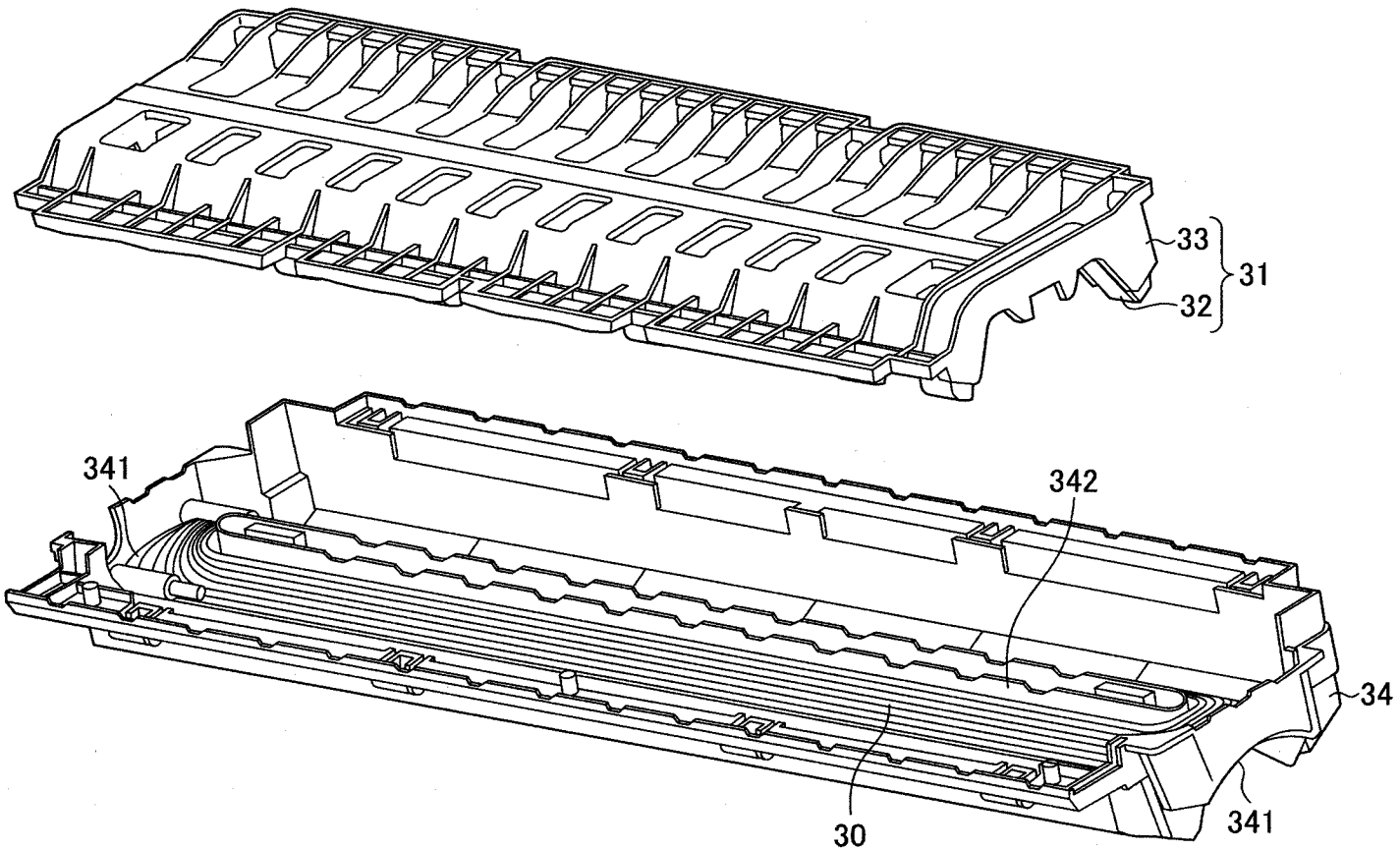
FIG. 3 is an exploded perspective view of a magnetic core unit and a coil supporting member of the fixing device illustrated in FIG. 2.
Figure 4:
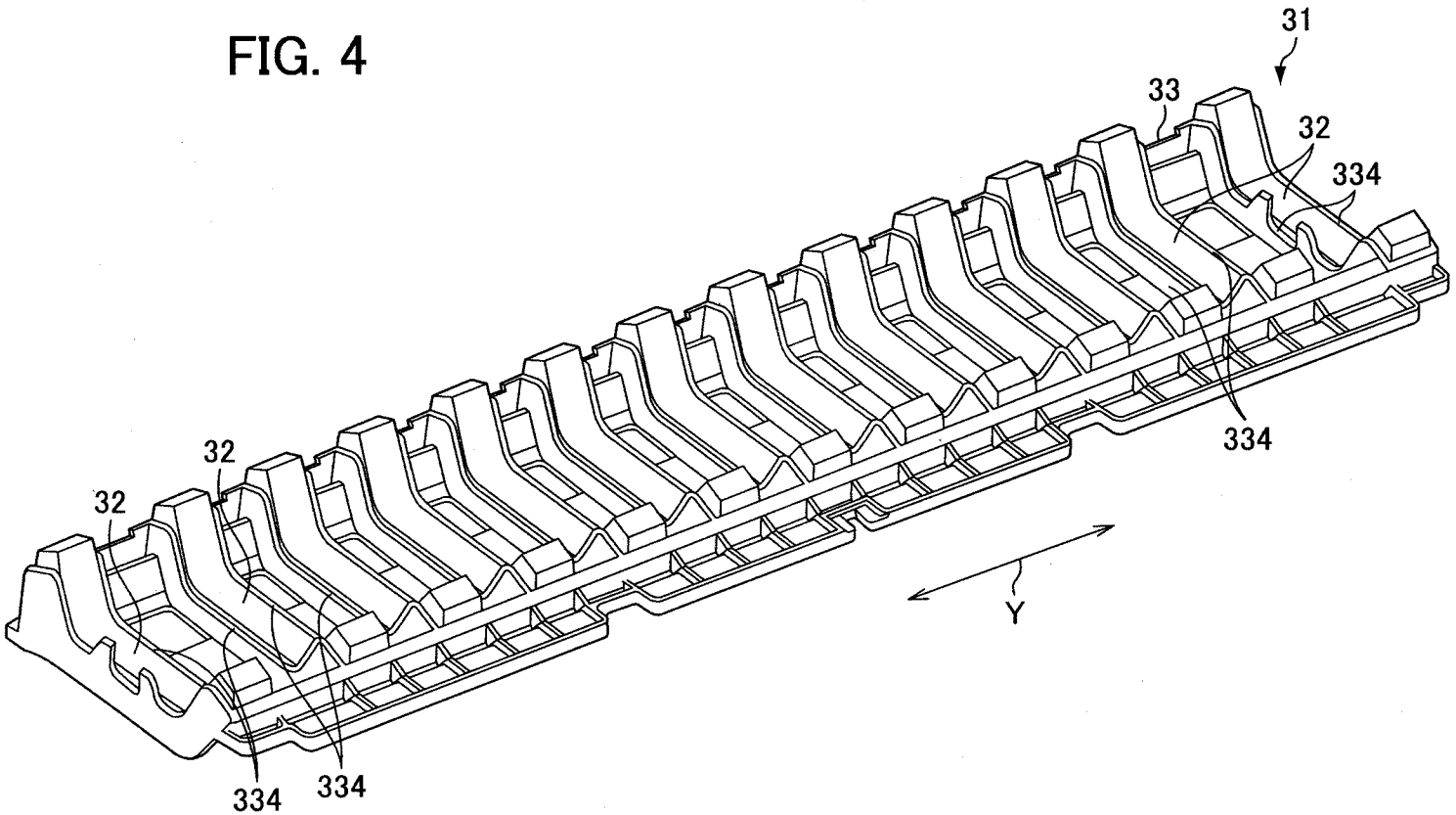
FIG. 4 is a perspective view illustrating arrangement of arch core portions of the magnetic core unit illustrated in FIG. 3.
Figure 5:
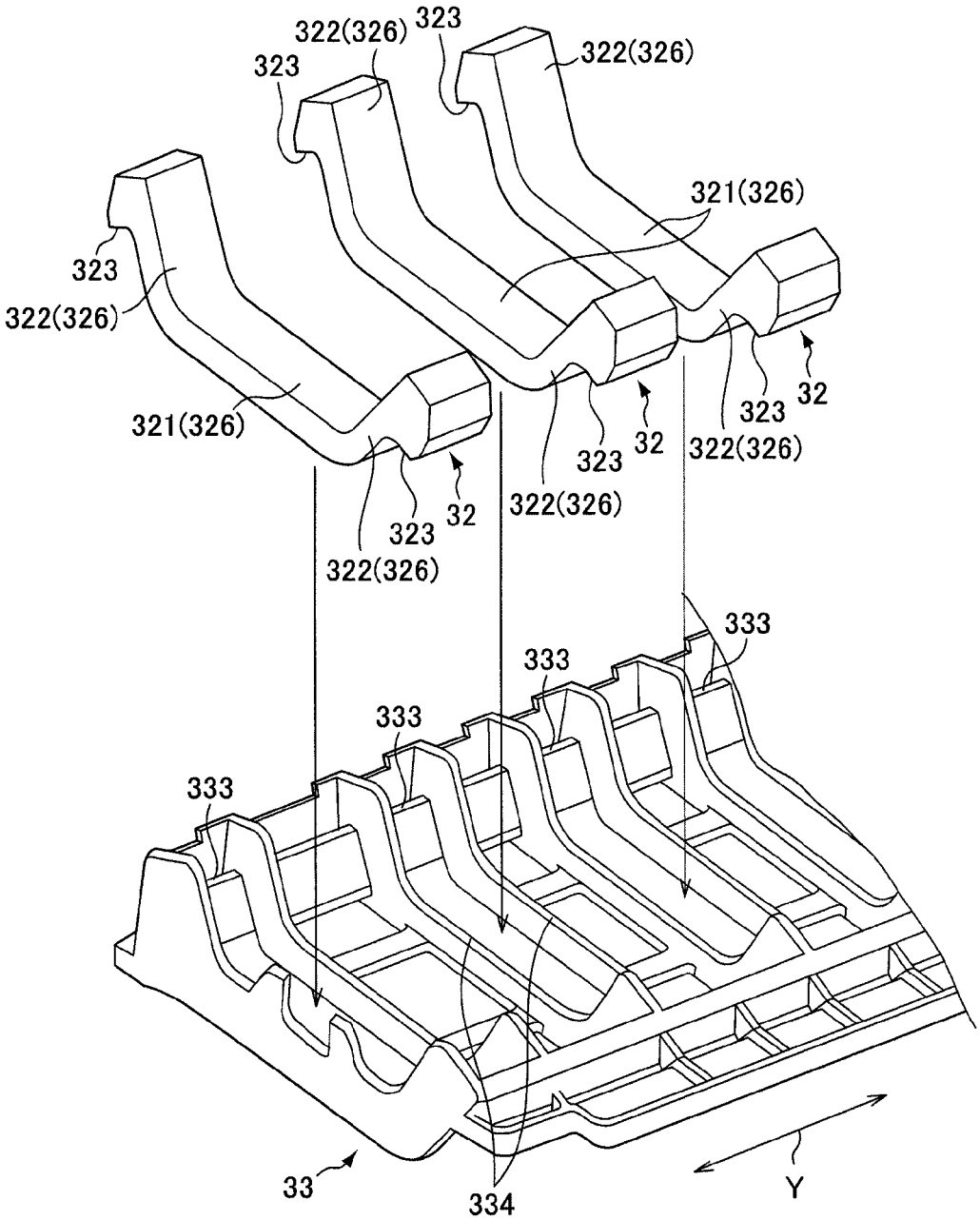
FIG. 5 is an exploded perspective view illustrating a structure of attaching the arch core portions to the core supporting member illustrated in FIG. 4.

Next, a structure of the fixing device 9 of the copy machine 1 according to the first embodiment is described with reference to FIGS. 2 to 10. FIG. 2 is an enlarged view of the fixing device 9 of the first embodiment. FIG. 3 is an exploded perspective view of a magnetic core unit 31 and a coil supporting member 34 of the fixing device 9 illustrated in FIG. 2. FIG. 4 is a perspective view illustrating arrangement of arch core portions 32 of the magnetic core unit 31 illustrated in FIG. 3. FIG. 5 is an exploded perspective view illustrating a structure of attaching the arch core portions 32 to a core supporting member 33 illustrated in FIG. 4.

Figure 6:
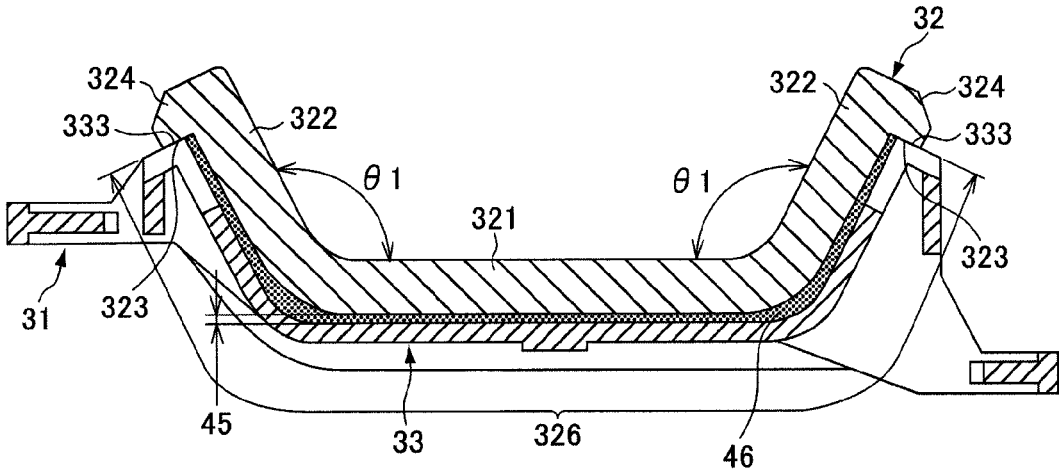
FIG. 6 is a lateral cross-sectional view illustrating the magnetic core unit in which the core supporting member supports the arch core portions.
Figure 7:
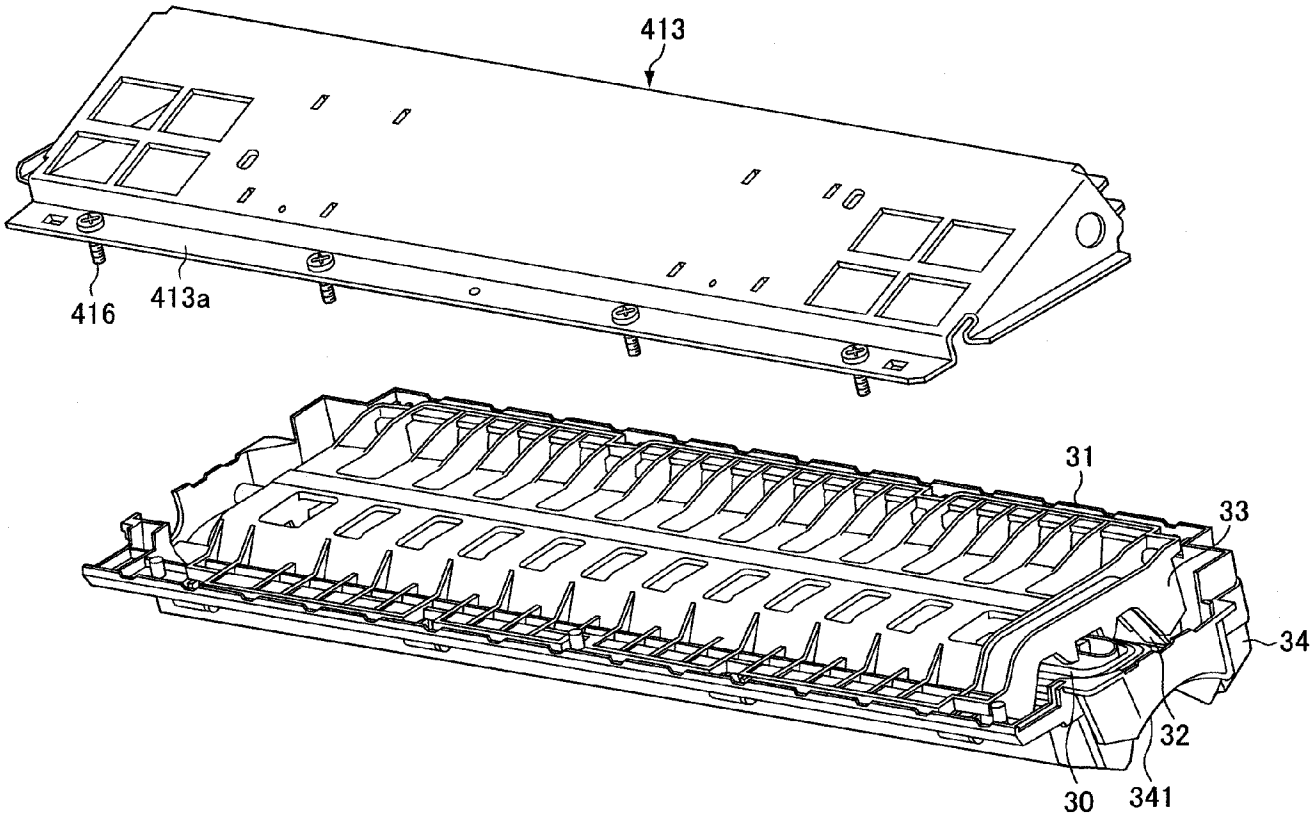
FIG. 7 is an exploded perspective view illustrating the core supporting member fixed to the coil supporting member using a cover.
Figure 8:
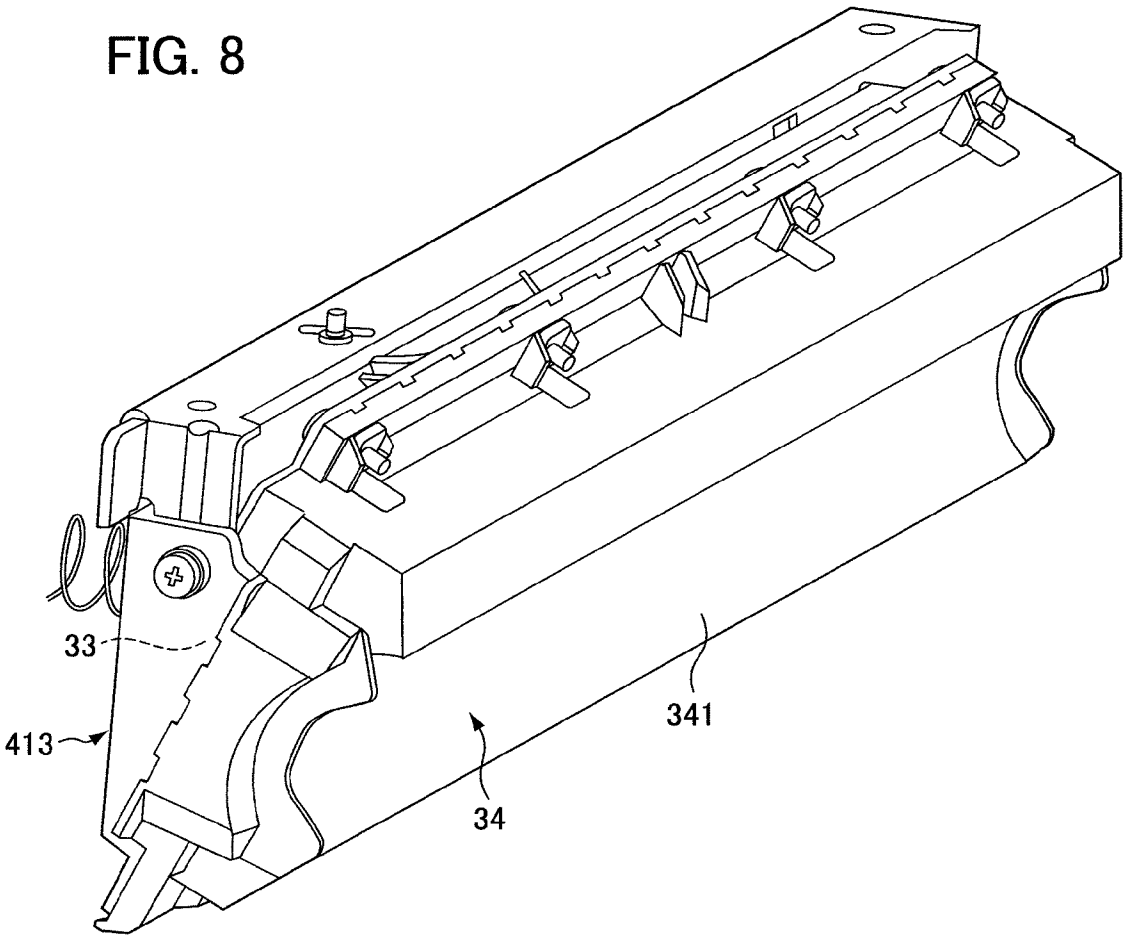
FIG. 8 is a perspective view illustrating the cover and the core supporting member that are fixed to the coil supporting member.
Figure 9:
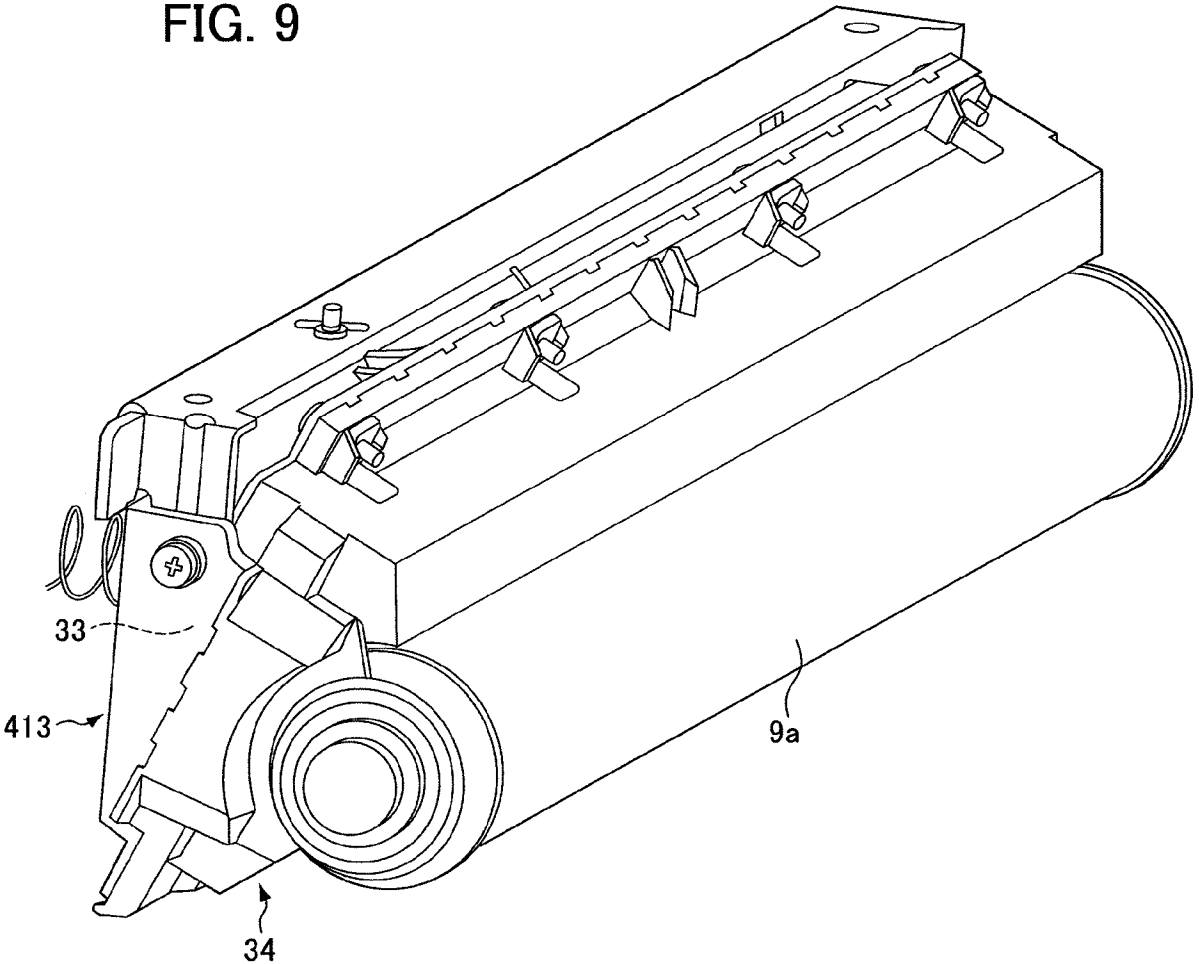
FIG. 9 is a perspective view illustrating a heating rotator that is disposed on a bottom wall side of the coil supporting member to which the cover and the core supporting member are fixed.
Figure 10:
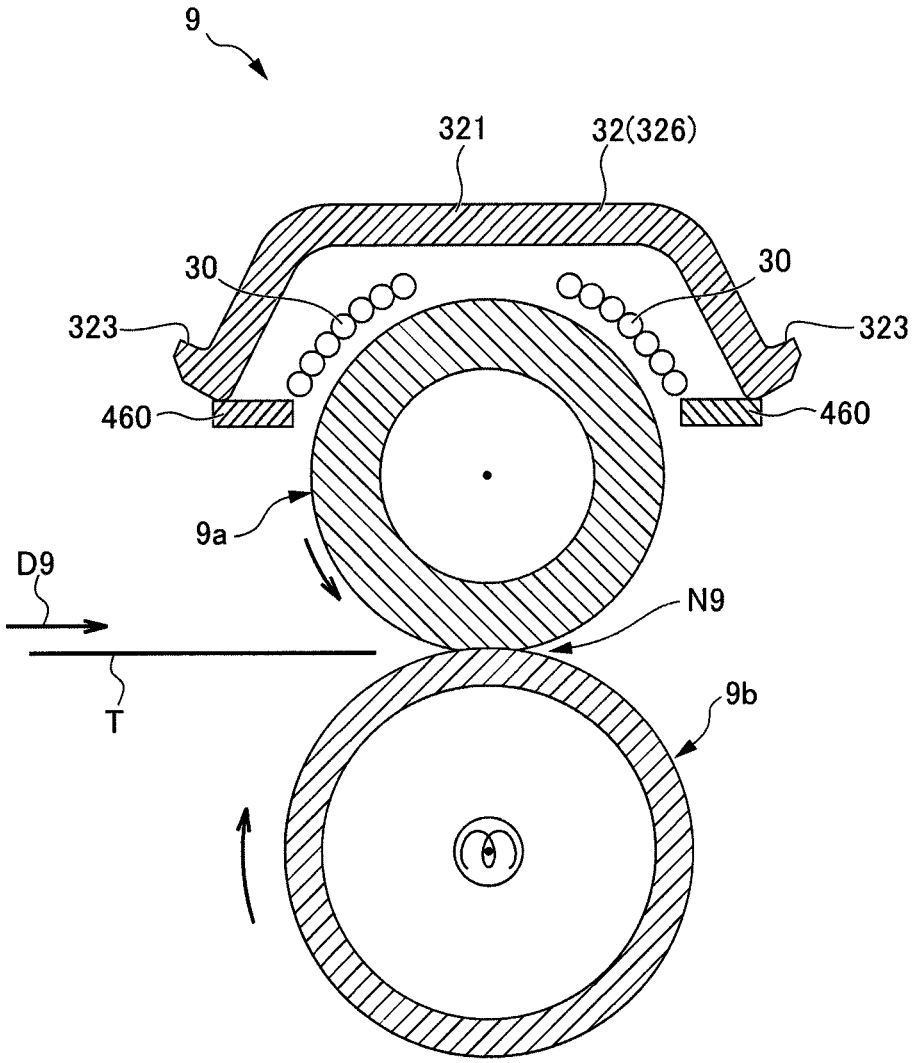
FIG. 10 is an explanatory diagram of a step in which a toner image on a sheet of paper is fixed thereonto at a fixing nip of the fixing device.

FIG. 6 is a lateral cross-sectional view illustrating the magnetic core unit 31 in which the core supporting member 33 supports the arch core portions 32. FIG. 7 is an exploded perspective view illustrating the core supporting member 33 being fixed to the coil supporting member 34 using a cover 413. FIG. 8 is a perspective view illustrating the cover 413 and the core supporting member 33 that are fixed to the coil supporting member 34. FIG. 9 is a perspective view illustrating the heating rotator 9*a* disposed on a bottom wall 341 of the coil supporting member 34 to which the cover 413 and the core supporting member 33 are fixed. FIG. 10 is an explanatory diagram of a step in which a toner image on a sheet of paper T is fixed at a fixing nip N9 of the fixing device 9.

As shown in FIG. 2, the fixing device 9 of the first embodiment is installed in the apparatus main body M as a fixing rotator unit that accommodates various components required for a fixing process in a fixing housing 400. When the cover body 40 shown in FIG. 1 is opened to the right relative to the apparatus main body M, the fixing housing 400 (fixing rotator unit) constituting the fixing device 9 is withdrawable to the right outside the apparatus main body M (in a direction of an arrow X in FIG. 2) by a rail mechanism 91 attached to the apparatus main body M. The fixing housing 400 withdrawn outside the apparatus main body M is again installable in the apparatus main body M.

The fixing device 9 of the first embodiment includes an induction coil 30, heating rotator 9*a*, pressurizing rotator 9*b*, magnetic core unit 31, and coil supporting member 34 inside the fixing housing 400. Among these components, the induction coil 30, the magnetic core unit 31 and the coil supporting member 34 constitute an external magnetic flux generation mechanism 410 that generates a magnetic flux for heating the heating rotator 9*a*. The fixing nip N9 is formed between the heating rotator 9*a* and the pressurizing rotator 9*b*.

The induction coil 30 is composed of a winding that generates a magnetic flux induced by a current flow and, as shown in FIG. 3, disposed wound on the coil supporting member 34 (described later). A detailed structure of the coil supporting member 34 is described later.

The heating rotator 9*a* is disposed in a region through which the magnetic flux generated by the induction coil 30 passes, and rotates about a first rotational shaft 420.

As shown in FIG. 2, the pressurizing rotator 9*b* is disposed to face the heating rotator 9*a*. The pressurizing rotator 9*b* rotates about a second rotational shaft 421. The second rotational shaft 421 is disposed in parallel with the first rotational shaft 420. The first rotational shaft 420 and the second rotational shaft 421 are rotatably supported by the fixing housing 400.

The fixing nip N9 is formed between the heating rotator 9*a* and the pressurizing rotator 9*b* as the pressurizing rotator 9*b* is pressed against the heating rotator 9*a*. A sheet of paper T, which is a sheet of recording medium, is nipped and conveyed at the fixing nip N9. The fixing nip N9 is an area in which, during feeding the sheet of paper T nipped between the heating rotator 9*a* and the pressurizing rotator 9*b*, the toner transferred to the sheet of paper T is fixed thereonto through being fused and applied pressure.

The magnetic core unit 31 forms a magnetic path passing inside an inner peripheral edge and outside an outer peripheral edge of the induction coil 30 shown in FIG. 3 to circularly enclose the induction coil 30. The magnetic core unit 31 includes a plurality of arch core portions 32 and the core supporting member 33, as shown in FIGS. 3 and 4.

As shown in FIG. 4, the plurality of arch core portions 32 is arranged at intervals in a direction of the first rotational shaft 420 (direction of an arrow Y shown in FIGS. 2 and 4). Each of the arch core portions 32 has a shape composed of a base portion 321 shaped like a substantially straight quadratic prism, and sloped end portions 322, as shown in FIGS. 5 and 6. The sloped end portions 322 extend respectively at an included angle θ1 relative to the base portion 321 at both ends thereof. Each arch core portion 32 has an arched shape. More specifically, the base portion 321 and the sloped end portions 322 of each arch core portion 32 form an arched shape facing an outer face of the heating rotator 9*a* across the induction coil 30 as shown in FIG. 2. The arched shape is a curved shape that has a concave directed to the heating rotator 9*a*.

In addition, as shown in FIG. 6, each arch core portion 32 of the first embodiment has a first engaging portion 323 that is formed on each of both end sides (an end portion of a sloped end portion 322 opposite to the base portion 321) and a core main body 326 that is formed between first engaging portions 323. The core main body 326 is a collective term indicating the base portion 321 and the sloped end portions 322. During attachment of an arch core portion 32 to the core supporting member 33, the first engaging portion 323 comes in contact with a predetermined position (described later) of the core supporting member 33 and functions as a contact surface for positioning the arch core portion 32 with respect to the core supporting member 33. In the first embodiment, the first engaging portion 323 is composed of a lower face of a projection 324 that projects outward from a distal portion of the sloped end portion 322. The core main body 326 lies in a region between the first engaging portions 323 positioned at both ends of the arch core portion 32.

When the core supporting member 33 supporting the arch core portions 32 is fixed to the coil supporting member 34 (described later), a distal portion of the core main body 326 comes in contact with a side core portion 460, as shown in FIG. 10. The side core portion 460 covers an outer periphery of the induction coil 30 supported by the coil supporting member 34 (described later).

The arch core portions 32 and the side core portions 460 are made of ferrite, for example, which is made of sintered ferrite powder of a ferromagnetic material. The arch core portions 32 and the side core portions 460 guide the magnetic flux generated by the induction coil 30 to the heating rotator 9*a*.

The core supporting member 33 is a molded product made of a heat-resistant insulation resin, and, as shown in FIG. 4, supports the plurality of arch core portions 32 at predetermined intervals in the direction of the first rotational shaft 420 (direction of the arrow Y shown in FIG. 4). As shown in FIG. 5, the core supporting member 33 has a plurality of second engaging portions 333 with which the first engaging portions 323 of the arch core portions 32 are engageable. Each of the second engaging portions 333 is a rib, having a distal portion with which the first engaging portion 323 comes in contact. The second engaging portions 333 are provided at specified intervals in the direction of the first rotational shaft 420 (direction of the arrow Y shown in FIG. 5).

In the first embodiment, when the first engaging portions 323 at both ends of the arch core portion 32 engage with the corresponding second engaging portions 333, a gap 45 is formed between the core main body 326 and the core supporting member 33. The gap 45 absorbs a dimensional error of the core main body 326 and increases performance associated with attachment of the arch core portions 32 to the core supporting member 33.

In addition, as shown in FIGS. 4 and 5, the core supporting member 33 of the first embodiment has a plurality of first restriction portions 334 corresponding to positions of the arch core portions 32. The first restriction portions 334 prevent the first engaging portions 323 of the arch core portions 32 from moving in the direction Y of the first rotational shaft 420. In the first embodiment, the first restriction portions 334 are partitions sandwiched by both side faces of adjacent arch core portions 32, which face each other in the direction Y of the first rotational shaft 420.

As shown in FIG. 6, the gap 45 is filled with a filler 46. The arch core portions 32 attached to the core supporting member 33 are supported by the core supporting member 33 in a state in which the gap 45 is filled with the filler 46. In the first embodiment, the filler 46 filling the gap 45 is an adhesive for bonding the arch core portion 32 and the core supporting member 33. For example, it may be preferable but not necessary that a silicone rubber adhesive excellent in elasticity is used.

As shown in FIGS. 2 and 3, the coil supporting member 34 is a housing for supporting the induction coil 30 and composed of a molded product made of a heat-resistant insulation resin. The coil supporting member 34 has a core 342 that penetrates the inner periphery of the induction coil 30, in a central portion of the bottom wall 341 on which the induction coil 30 is placed. In addition, as shown in FIG. 2, the bottom wall 341 is formed such that a lateral cross section thereof has an arcuate shape compatible with the outer peripheral surface of the heating rotator 9*a*.

As shown in FIGS. 3 and 7, a face of the core supporting member 33 on which the arch core portions 32 are disposed and a face of the coil supporting member 34 on which the induction coil 30 is disposed are caused to come in contact with each other, such that the coil supporting member 34 and the core supporting member 33 are fixed.

As shown in FIG. 7, the cover 413 is attached to the core supporting member 33 for covering an outer surface thereof. As shown in FIG. 2, the cover 413 is made of a non-magnetic metallic plate and forms a gap 415 between an inner surface of the cover 413 and an outer surface of the core supporting member 33, which allows cooling air to pass through. The gap 415 increases the performance associated with heat rejection of the magnetic core unit 31.

The cover 413 has a flange 413*a* for fixing at an outer periphery thereof. Screws 416 for fastening the core supporting member 33 and the coil supporting member 34 together are attached to the flange 413*a*. In other words, during a step of the cover 413 fixed to the coil supporting member 34 by screw, the core supporting member 33 is fixed to the coil supporting member 34 along with the cover 413.

As shown in FIG. 7, the coil supporting member 34 and the core supporting member 33 that are fixed together define a positional relationship between the induction coil 30 and the arch core portions 32 in the fixing device 9 of the first embodiment.

In the fixing device 9 of the first embodiment, the magnetic flux generated by the induction coil 30 causes the heating rotator 9*a* to generate heat to reach a predetermined temperature during the fixing process. In addition, the pressurizing rotator 9*b* is pressed against the heating rotator 9*a* and the fixing nip N9, for nipping a sheet of paper T, is formed between the heating rotator 9*a* and the pressurizing rotator 9*b* as shown in FIG. 10. When a sheet of paper T, which is being conveyed in the second paper feeding path L2 (see FIG. 1) in a paper feeding direction shown by an arrow D9 in FIG. 10, is fed to the fixing nip N9, the toner image transferred to the sheet of paper T is fixed thereonto by heat and pressure applied to the sheet of paper T while passing through the fixing nip N9.

The sheet of paper T having passed through the fixing nip N9 is fed to the third paper feeding path L3 disposed downstream of the fixing device 9 (see FIG. 1) by a separating plate 450 provided in the fixing housing 400 as shown in FIG. 2 and a pair of forced feed rollers 431 (431A, 431B).

The fixing device 9 of the first embodiment provides, for example, the following effects.

The fixing device 9 of the first embodiment includes: an induction coil (30) configured to generate a magnetic flux; a heating rotator (9*a*) disposed in a region through which the magnetic flux generated by the induction coil (30) passes, the heating rotator being configured to rotate about a first rotational shaft (420); a pressurizing rotator (9*b*) disposed to face the heating rotator (9*a*); a fixing nip (N9) formed between the heating rotator (9*a*) and the pressurizing rotator (9*b*); and a magnetic core unit (31) configured to form a magnetic path passing inside an inner peripheral edge and outside an outer peripheral edge of the induction coil (30) such that the magnetic path circularly encloses the induction coil (30), wherein the magnetic core unit (31) includes a plurality of arch core portions (32) and a core supporting member (33) supporting the arch core portions (32), the arch core portions (32) each having an arch shape facing an outer surface of the heating rotator (9*a*) with the induction coil (30) being interposed therebetween and being arranged at intervals in a direction of the first rotational shaft (420); each of the arch core portions (32) has first engaging portions (323) formed respectively at both ends thereof and a core main body (326) formed between the first engaging portions (323); and the core supporting member (33) has second engaging portions (333) with which the first engaging portions (323) are engageable.

According to the first embodiment, when the arch core portions 32, which guide the magnetic flux to the heating rotator 9*a*, are attached to the core supporting member 33, it is possible to easily position each of the arch core portions 32 with respect to the core supporting member 33. This positioning is simply performed by engaging the first engaging portions 323 at both ends of each of the arch core portions 32 with the second engaging portions 333 of the core supporting member 33 without dedicated assembly support equipment. Therefore, the first embodiment facilitates assembly of the core supporting member 33 of the magnetic core unit 31 and the arch core portions 32.

In the fixing device 9 of the first embodiment, in a state in which the first engaging portions 323 are engaged with the second engaging portions 333, the gap 45 is formed between the core main body 326 and the core supporting member 33. In other words, the core main body 326 is not in direct contact with the core supporting member 33. Accordingly, it is possible to prevent a variation from occurring in positioning of the arch core portions 32 due to interference between the core main body 326 that is likely to have a dimensional error and the core supporting member 33. Therefore, the first embodiment increases positioning accuracy of the plurality of arch core portions 32 and further improves the performance associated with the assembly of the core supporting member 33 of the magnetic core unit 31 and the arch core portions 32.

In addition, in the fixing device 9 of the first embodiment, the arch core portions 32 are supported by the core supporting member 33 in a state in which the gap 45 is filled with the filler 46. As a result, each of the arch core portions 32 attached to the core supporting member 33 is uniformly supported by the core supporting member 33 over a large region thereof by the filler 46, while being free of the dimensional error or the like of each of the arch core portions 32. In this manner, it is possible to increase supporting strength of the arch core portions 32 by the core supporting member 33.

In the fixing device 9 of the first embodiment, the filler 46 is an adhesive for bonding the arch core portions 32 and the core supporting member 33. As a result, a broad area of each of the arch core portions 32 can be bonded and fixed to the core supporting member 33 due to adhesion strength of the filler 46, thereby further increasing supporting strength provided for the arch core portions 32 by the core supporting member 33.

The fixing device 9 of the first embodiment is configured to further include the coil supporting member 34 for supporting the induction coil 30. The coil supporting member 34 and the core supporting member 33 that are fixed together define a positional relationship between the induction coil 30 and the arch core portions 32. In this manner, according to the first embodiment, it is possible to maintain a distance and the like between the induction coil 30 and the arch core portions 32 constant only by fixing the coil supporting member 34 and the core supporting member 33, without additional components for positioning. As a result, according to the first embodiment, it is possible to increase the performance associated with guiding of a magnetic flux to the heating rotator 9*a*, causing the heating rotator 9*a* to generate a desired amount of heat as designed.

In addition, in the fixing device 9 of the first embodiment, the core supporting member 33 is provided with the first restriction portions 334 that prevent the first engaging portions 323 of each of the arch core portions 32 from moving in the direction of the first rotational shaft 420. Therefore, the plurality of arch core portions 32 can be fixed and positioned accurately at predetermined intervals in the direction of the first rotational shaft 420.

Since the magnetic flux passing through the heating rotator 9*a* is equalized at every position in the axial direction of the heating rotator 9*a*, it is possible to suppress variations in heat generation. As a result, it is possible to realize the performance associated with stable fixing at every position in the axial direction of the heating rotator 9*a*.

Second Embodiment

Next, a second embodiment of the present disclosure is described. Descriptions of the second embodiment will focus mainly on the points of difference from the first embodiment, and those components of configuration that are the same as the first embodiment are denoted with the same reference symbols, and detailed descriptions thereof will be omitted.

Descriptions of the first embodiment are applicable to points that are not described in particular in relation to the second embodiment. In addition, the second embodiment provides the same effects as the first embodiment.

Figure 11:
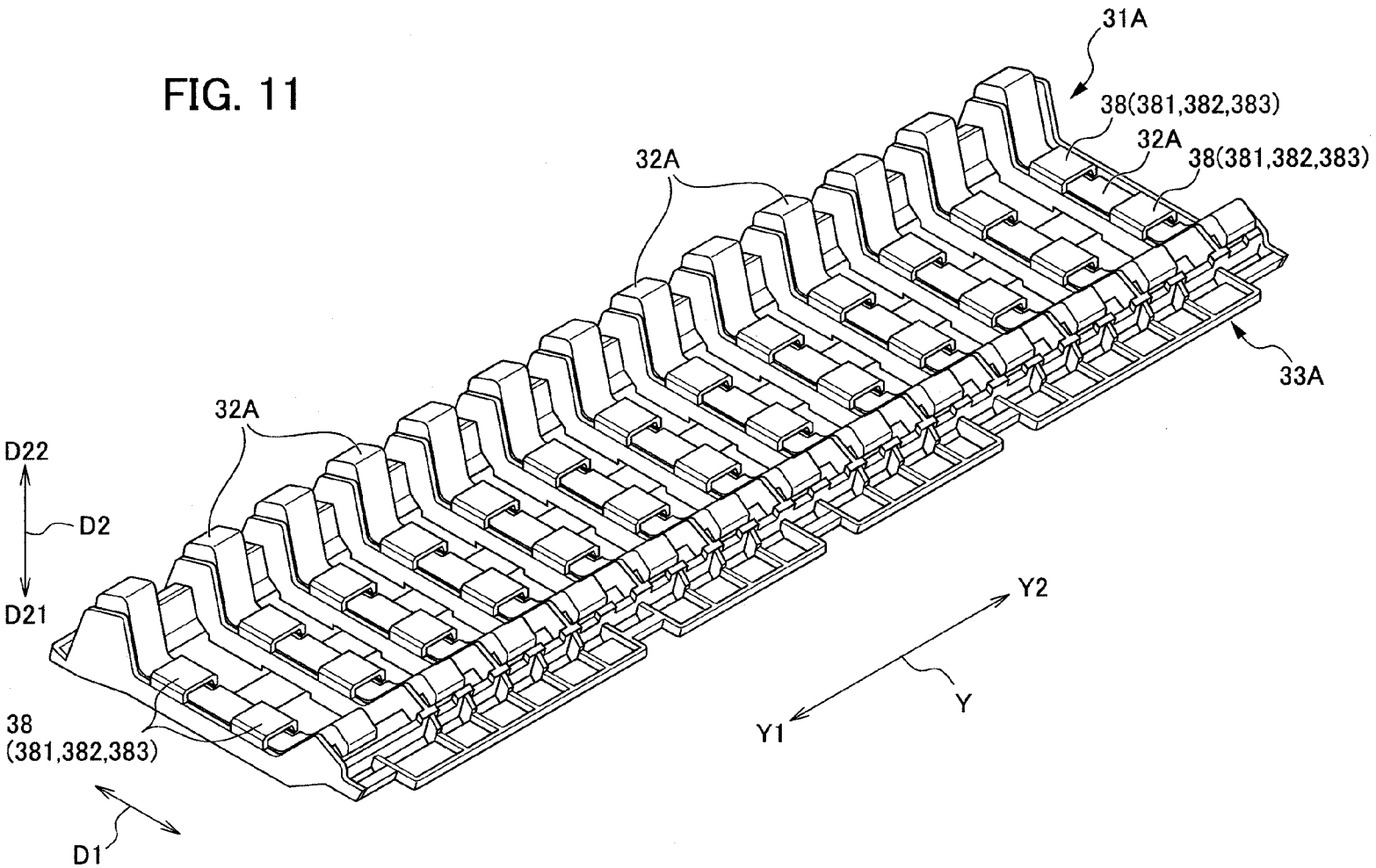
FIG. 11 is a perspective view illustrating arrangement of arch core portions of a magnetic core unit of a fixing device according to a second embodiment.
Figure 12:
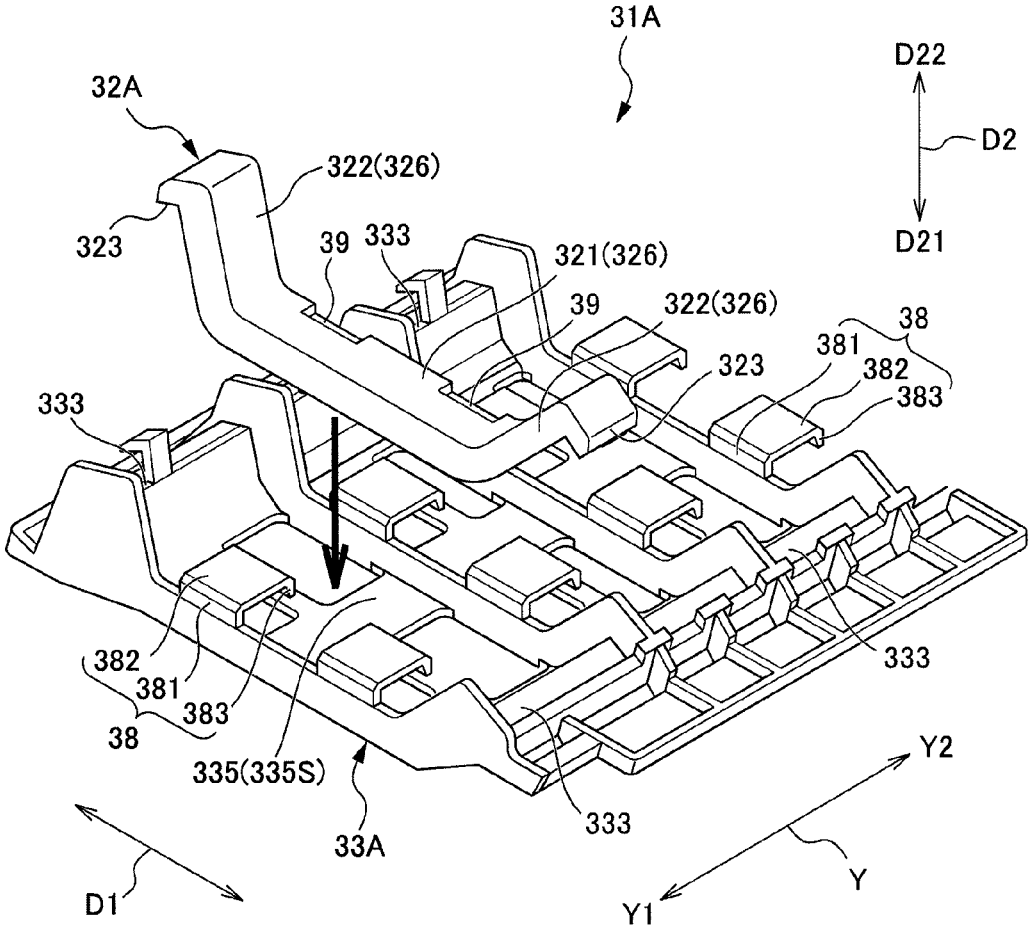
FIG. 12 is a perspective view sequentially illustrating steps of attaching the arch core portions to a core supporting member illustrated in FIG. 11.
Figure 13:
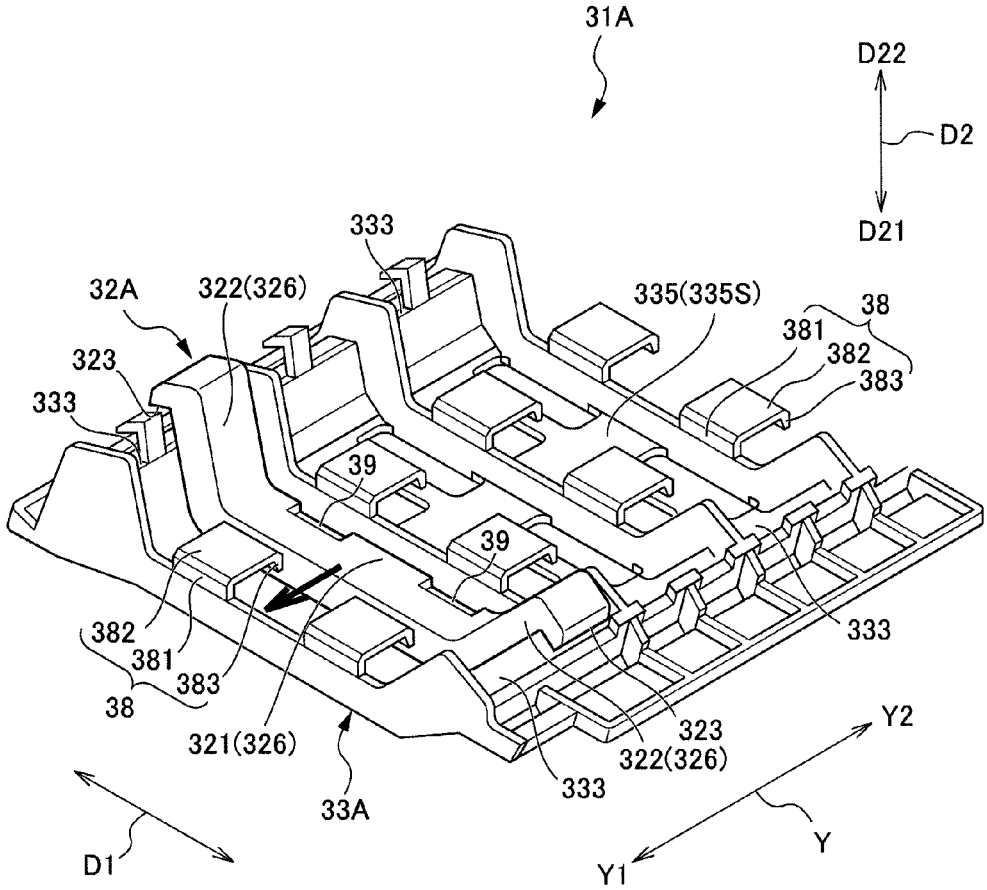
FIG. 13 is a perspective view illustrating a step subsequent to FIG. 12.
Figure 14:
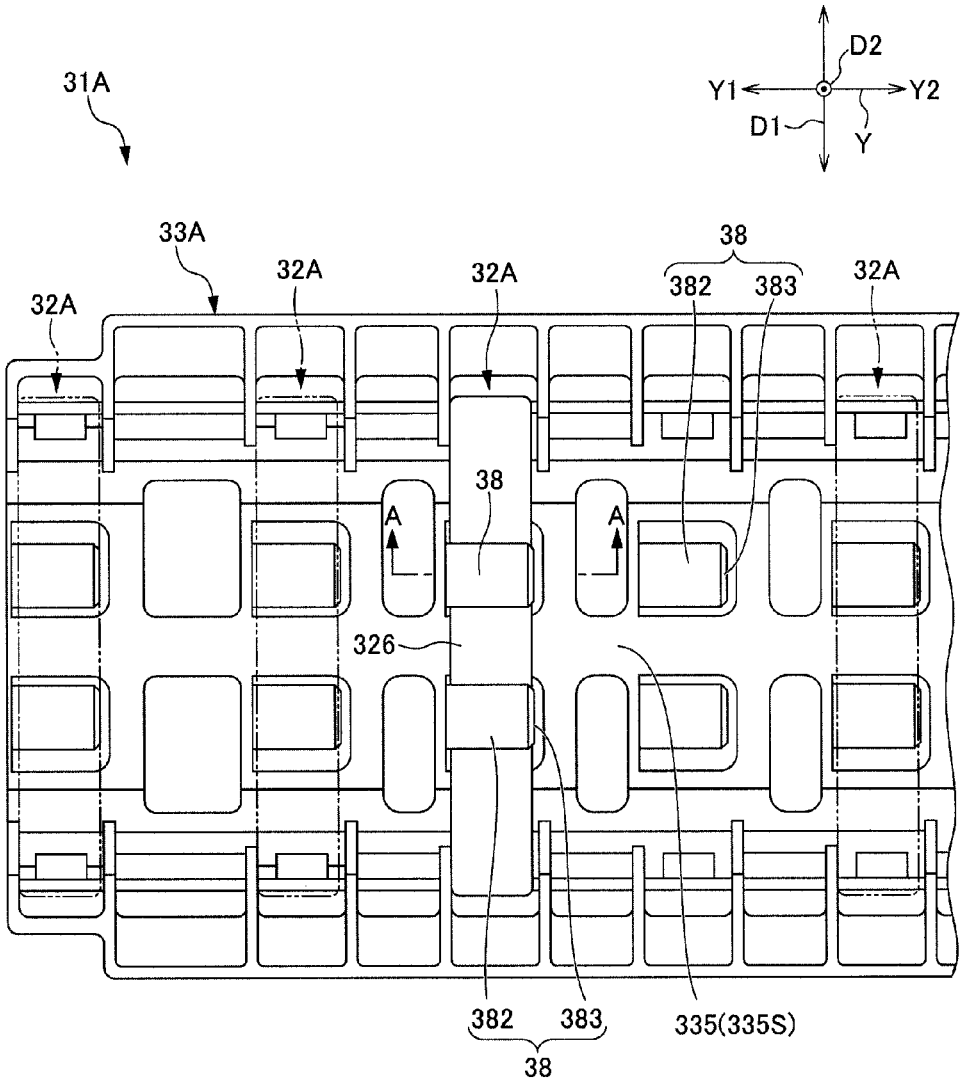
FIG. 14 is a diagram of the magnetic core unit shown in FIG. 11 when viewed from a thickness direction of the core main body of the arch core portion.
Figure 15:
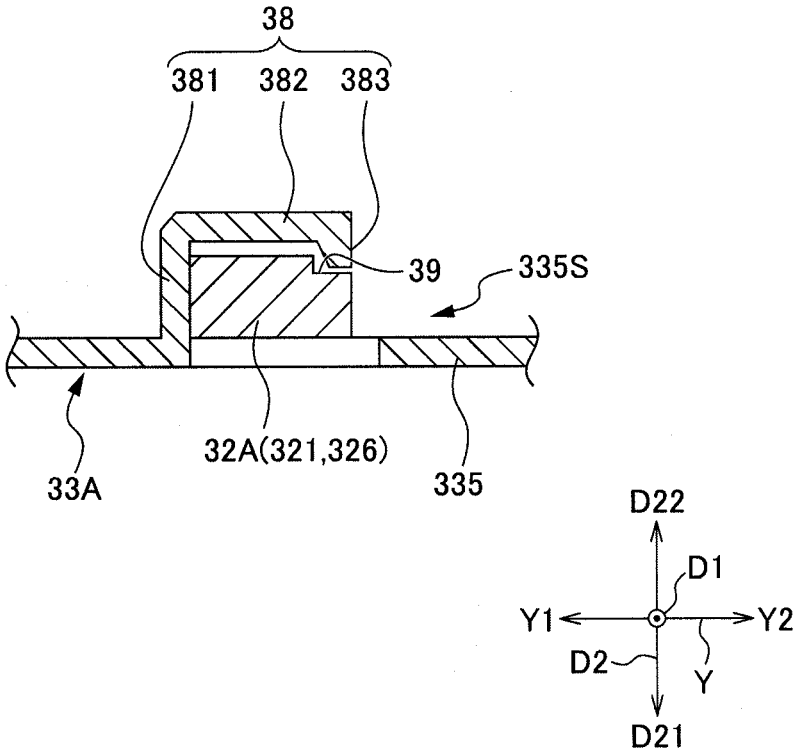
FIG. 15 is a cross-sectional view taken along a line A-A of FIG. 14.

The second embodiment is described hereinafter with reference to FIGS. 11 to 15. FIG. 11 is a perspective view illustrating arrangement of arch core portions 32A of a magnetic core unit 31A of a fixing device 9 according to a second embodiment. FIG. 12 is a perspective view sequentially illustrating steps of attaching an arch core portion 32A to the core supporting member 33A illustrated in FIG. 11. FIG. 13 is a perspective view illustrating a step subsequent to FIG. 12. FIG. 14 is a diagram of the magnetic core unit 31A illustrated in FIG. 11 viewed from a thickness direction of a core main body 326 of the arch core portion 32A. FIG. 15 is a cross-sectional view taken along a line A-A of FIG. 14.

The second embodiment is different from the first embodiment mainly in that: the core supporting member 33A is provided with a hook portion 38 that functions as a second restriction portion and a third restriction portion; and the arch core portion 32A is provided with an engaging concave portion 39 that engages with the hook portion 38. For the second embodiment, descriptions are mainly provided for the hook portion 38 and the engaging concave portion 39.

In the second embodiment, a magnetic core unit 31A includes a plurality of arch core portions 32A and the core supporting member 33A, as shown in FIGS. 11 to 15.

As shown in FIGS. 11 and 14, the plurality of arch core portions 32A is arranged at intervals in a direction of a first rotational shaft 420 (direction of the arrow Y). Each of the arch core portions 32A is provided with a base portion 321 shaped like a substantially straight quadratic prism and sloped end portions 322, as shown in FIGS. 12 and 15. The sloped end portions 322 extend at a predetermined included angle with respect to the base portion 321 at both ends thereof. The arch core portion 32A has an arched shape.

In addition, as shown in FIG. 12, each of the arch core portions 32A of the first embodiment has first engaging portions 323 and a core main body 326. The first engaging portions 323 are formed respectively at both ends (end portions of the sloped end portions 322 opposite to the base portion 321). The core main body 326 is formed between the first engaging portions 323. The core main body 326 is a collective term indicating the base portion 321 and the sloped end portions 322. During attachment of the arch core portion 32A to the core supporting member 33A, the first engaging portions 323 come in contact with predetermined positions (described later) of the core supporting member 33A, functioning as contact surfaces for positioning the arch core portion 32 with respect to the core supporting member 33A. In addition, the first engaging portions 323 function as contact surfaces when the arch core portion 32A is inserted by sliding into the hook portion 38 (described later) and installed.

The core supporting member 33A supports the plurality of arch core portions 32A at predetermined intervals in the direction of the first rotational shaft 420 (direction of the arrow Y shown in FIG. 11) as shown in FIGS. 11 to 14. As shown in FIGS. 12 and 13, the core supporting member 33A has a plurality of second engaging portions 333 with which the first engaging portions 323 of the arch core portions 32A are engageable. The second engaging portions 333 are provided at predetermined intervals in the direction of the first rotational shaft 420 (direction of the arrow Y shown in FIGS. 12 and 13). The second engaging portions 333 function as slide guides when the arch core portion 32A is inserted by sliding into the hook portion 38 (described later) and installed.

As shown in FIGS. 12 to 14, the core supporting member 33A includes a base portion 335 shaped like a plate. The core supporting member 33A has a plurality of hook portions 38 at a side of the base portion 335 on which the arch core portions 32A are disposed.

The plate-like base portion 335 extends in a Y-D1 plane. In the following description, for the sake of explanation, a direction of sliding an arch core portion 32A into a hook portion 38 (described later) is referred to as a Y1 direction and a direction opposite to the Y1 direction is referred to as a Y2 direction. A thickness direction of the plate-like base portion 335 is referred to as a D2 direction. A direction from the core main body 326 of the arch core portion 32A to the base portion 335 is referred to as a D21 direction and a direction opposite to the D21 direction is referred to as a D22 direction.

Two pieces of hook portions 38 are provided for each arch core portion 32A. Two hook portions 38 are provided at a predetermined interval in the D1 direction. Two hook portions 38 are provided as a pair at a predetermined interval in the Y direction. The pair of hook portions 38 fixes an arch core portion 32A to the core supporting member 33A.

The hook portion 38 has a cross-section shaped substantially like a character U in a Y-D2 plane, as shown in FIG. 15. The hook portion 38 has an upright portion 381 as a third restriction portion; a horizontal portion 382 as a second restriction portion; and a claw portion 383 as the third restriction portion. The upright portion 381 stands upright at the base portion 335 projecting toward the D22 direction (a side on which the arch core portion 32A is disposed).

The horizontal portion 382 formed integrally with the upright portion 381 bends at a right angle from a distal portion (an end portion in the D22 direction) of the upright portion 381, and extends in the Y2 direction. The claw portion 383, which is shaped like a claw and formed integrally with the horizontal portion 382, bends at a right angle from a distal portion (an end portion in the Y2 direction) of the horizontal portion 382, and projects in the D21 direction. A space (in the D2 direction) between the base portion 335 and the distal portion (an end portion in the D21 direction) of the claw portion 383 is open in the Y direction.

As shown in FIG. 15, when the core main body 326 of the arch core portion 32A is disposed inside the hook portion 38, the base portion 335 and the horizontal portion 382 function as the second restriction portion, preventing the core main body 326 of the arch core portion 32A from moving in the thickness direction of the core main body 326. The thickness direction of the core main body 326 coincides with the D2 direction. The base portion 335 prevents the core main body 326 from moving in the D21 direction. The horizontal portion 382 prevents the core main body 326 from moving in the D22 direction. Although a small gap is allowable between the core main body 326 and the horizontal portion 382, it is preferable but not necessary that there is no gap therebetween. It is more preferable but not necessary that the horizontal portion 382 elastically presses the core main body 326 in the D21 direction.

In addition, when the core main body 326 of the arch core portion 32A is disposed inside the hook portion 38, the upright portion 381 and the claw portion 383 function as the third restriction portion, preventing the core main body 326 of the arch core portion 32A from moving in the direction Y of the first rotational axis 420. The upright portion 381 prevents the core main body 326 from moving in the Y1 direction. The claw portion 383 prevents the core main body 326 from moving in the Y2 direction. Although a small gap is allowable between the core main body 326 and the upright portion 381 or the claw portion 383, it is preferable but not necessary that there is no gap therebetween. It is more preferable but not necessary that the upright portion 381 and the claw portion 383 elastically press the core main portion 326 in the Y direction.

The core main body 326 of the arch core portion 32A has an engaging concave portion 39. The engaging concave portion 39 is concave in the thickness direction of the core main portion 326 (D21 direction) and the Y1 direction. The claw portion 383 engages with the engaging concave portion 39. Two pieces of engaging concave portions 39 are provided at positions of the core main body portion 326, which geometrically correspond to claw portions 383 of the hook portion 38.

Between adjacent pairs of hook portions 38, which are adjacent to each other in the Y direction and on a D22-side of the base portion 335, a space 335S is provided, in which the core main body 326 of the arch core portion 32A can be placed. By temporarily disposing the core main body 326 in the space 335S, it is possible to easily engage the core main body 326 of the arch core portion 32A with the hook portion 38 (easily arrange the core main body 326 inside the hook portion 38).

More specifically, first, the core main body 326 of the arch core portion 32A is placed in the space 335S, as shown in FIGS. 12 and 13. Here, the first engaging portions 323 on both ends of the arch core portion 32A engage with the corresponding second engaging portions 333. Next, as shown in FIGS. 14 and 15, the core main body 326 is inserted by sliding into the hook portion 38, through the space between the base portion 335 and the claw portion 383. During this sliding, the first engaging portions 323 and the second engaging portions 333 function as slide guides for regulating a sliding direction of the arch core portion 32A.

When the core main body 326 is disposed inside the hook portion 38, the base portion 335 and the horizontal portion 382 of the hook portion 38 prevent the arch core portion 32A from moving in the thickness direction of the core main body 326 (D2 direction, D21 direction, and D22 direction). In addition, the upright portion 381 and the claw portion 383 of the hook portion 38 prevent the arch core portion 32A from moving in the direction Y (Y1 direction and Y2 direction) of the first rotational axis 420.

The fixing device of the second embodiment provides, for example, the following effects.

In the fixing device of the second embodiment, the core supporting member 33A is provided with the horizontal portion 382 of the hook portion 38 as the second restriction portion that prevents the core main body 326 of the arch core portion 32A from moving in the thickness direction of the core main body 326 (D22 direction). In this manner, according to the second embodiment, it is possible to realize a structure that prevents the arch core portion 32A from moving in the thickness direction of the core main body 326 (D22 direction), without bonding the arch core portion 32A and the core supporting member 33A.

In the fixing device of the second embodiment, the core supporting member 33A is provided with the upright portion 381 and the claw portion 383 of the hook portion 38 as the third restriction portion that prevents the core main body 326 of the arch core portion 32A from moving in the direction Y of the first rotational axis 420 (Y1 direction and Y2 direction). In this manner, according to the second embodiment, it is possible to realize a structure that prevents the arch core portion 32A from moving in the direction Y of the first rotational axis 420, without bonding the arch core portion 32A and the core supporting member 33A.

In the fixing device of the second embodiment, the core main body 326 of the arch core portion 32A is provided with the engaging concave portion 39 that is concave in the thickness direction of the core main body 326 (D21 direction) and with which the claw portion 383 engages.

In this manner, according to the second embodiment, it is possible to reinforce the engagement between the arch core portion 32A and the claw portion 383 of the hook portion 38, without bonding the arch core portion 32A and the core supporting member 33A.

Exemplary embodiments of the present disclosure have been described above; however, the present disclosure is not limited thereto and can be carried out in various modes.

For example, in the second embodiment, it is preferable but not necessary that no adhesive is used for bonding the arch core portion 32A and the core supporting member 33A; however, it may be alternatively possible that an adhesive is used supplementarily for reinforcement of fixation between the arch core portion 32A and the core supporting member 33A.

In the above embodiments, the copy machine 1 has been exemplified as an image forming device performing color printing; however, the present disclosure is not limited thereto and can be a black and white copy machine, a printer, a facsimile machine and a multi-functional peripheral having functions thereof. In addition, the recording medium is not limited to a sheet of paper, and may be a film sheet, for example.

The invention claimed is:

1. A fixing device comprising:

an induction coil configured to generate a magnetic flux;

a heating rotator disposed in a region through which the magnetic flux generated by the induction coil passes, the heating rotator being configured to rotate about a first rotational shaft;

a pressurizing rotator disposed to face the heating rotator;

a fixing nip formed between the heating rotator and the pressurizing rotator, where a recording medium is nipped and conveyed; and a magnetic core unit configured to form a magnetic path passing inside an inner peripheral edge and outside an outer peripheral edge of the induction coil such that the magnetic path circularly encloses the induction coil, wherein the magnetic core unit includes a plurality of arch core portions and a core supporting member supporting the arch core portions, the arch core portions each having an arch shape facing an outer surface of the heating rotator with the induction coil being interposed therebetween and being arranged at intervals in a direction of the first rotational shaft;

each of the arch core portions has first engaging portions formed respectively at both ends thereof and a core main body formed between the first engaging portions; and the core supporting member has second engaging portions with which the first engaging portions are engageable, wherein the core supporting member has a second restriction portion configured to prevent the core main body of each of the arch core portions from moving in a thickness direction of the core main body, wherein the core supporting member has a third restriction portion that is formed integrally with the second restriction portion and configured to prevent the core main body of each of the arch core portions from moving in the direction of the first rotational shaft, and wherein the third restriction portion is shaped like a claw; and the core main body of each of the arch core portions has an engaging concave portion that is concave in the thickness direction of the core main body and with which the claw-shaped third restriction portion engages.

2. The fixing device according to claim 1, wherein a gap is formed between the core main body and the core supporting member in a state in which the first engaging portions engage with the second engaging portions, wherein the arch core portions are supported by the core supporting member in a state in which the gap is filled with a filler, and wherein the filler comprises an adhesive for bonding the arch core portions and the core supporting member.

3. The fixing device according to claim 2 further comprising a coil supporting member configured to support the induction coil, wherein the coil supporting member and the core supporting member are fixed so as to define a positional relationship between the induction coil and the arch core portions.

4. The fixing device according to claim 2, wherein the core supporting member has a first restriction portion configured to prevent the first engaging portions of each of the arch core portions from moving in the direction of the first rotational shaft.

5. An image forming apparatus comprising:

an image bearing member on a surface of which an electrostatic latent image is formed;

a development unit configured to develop the electrostatic image formed on the surface of the image bearing member as a toner image;

an image transfer portion configured to transfer the toner image formed on the surface of the image bearing member directly or indirectly to a recording medium; and a fixing device configured to fix the toner image onto the recording medium, wherein the fixing device comprises:

an induction coil configured to generate a magnetic flux;

a heating rotator disposed in a region through which the magnetic flux generated by the induction coil passes, the heating rotator being configured to rotate about a first rotational shaft;

a pressurizing rotator disposed to face the heating rotator;

a fixing nip formed between the heating rotator and the pressurizing rotator, where the recording medium is nipped and conveyed; and a magnetic core unit configured to form a magnetic path passing inside an inner peripheral edge and outside an outer peripheral edge of the induction coil such that the magnetic path circularly encloses the induction coil, wherein the magnetic core unit includes a plurality of arch core portions and a core supporting member supporting the arch core portions, the arch core portions each having an arch shape facing an outer surface of the heating rotator with the induction coil being interposed therebetween and being arranged at intervals in a direction of the first rotational shaft;

each of the arch core portions has first engaging portions formed respectively at both ends thereof and a core main body formed between the first engaging portions; and the core supporting member has second engaging portions with which the first engaging portions are engageable, wherein the core supporting member has a second restriction portion configured to prevent the core main body of each of the arch core portions from moving in a thickness direction of the core main body, wherein the core supporting member has a third restriction portion that is formed integrally with the second restriction portion and configured to prevent the core main body of each of the arch core portions from moving in the direction of the first rotational shaft, and wherein the third restriction portion is shaped like a claw; and the core main body of each of the arch core portions has an engaging concave portion that is concave in the thickness direction of the core main body and with which the claw-shaped third restriction portion engages.

6. The image forming apparatus according to claim 5, wherein a gap is formed between the core main body and the core supporting member in a state in which the first engaging portions engage with the second engaging portions, wherein the arch core portions are supported by the core supporting member in a state in which the gap is filled with a filler, and wherein the filler comprises an adhesive for bonding the arch core portions and the core supporting member.

7. The image forming apparatus according to claim 6 further comprising a coil supporting member configured to support the induction coil, wherein the coil supporting member and the core supporting member are fixed so as to define a positional relationship between the induction coil and the arch core portions.

8. The image forming apparatus according to claim 6, wherein the core supporting member has a first restriction portion configured to prevent the first engaging portions of each of the arch core portions from moving in the direction of the first rotational shaft.

9. A fixing device comprising:

an induction coil configured to generate a magnetic flux;

a heating rotator disposed in a region through which the magnetic flux generated by the induction coil passes, the heating rotator being configured to rotate about a first rotational shaft;

a pressurizing rotator disposed to face the heating rotator;

a fixing nip formed between the heating rotator and the pressurizing rotator, where a recording medium is nipped and conveyed; and a magnetic core unit configured to form a magnetic path passing inside an inner peripheral edge and outside an outer peripheral edge of the induction coil such that the magnetic path circularly encloses the induction coil, wherein the magnetic core unit includes a plurality of arch core portions and a core supporting member supporting the arch core portions, the arch core portions each having an arch shape facing an outer surface of the heating rotator with the induction coil being interposed therebetween and being arranged at intervals in a direction of the first rotational shaft;

each of the arch core portions has projections formed respectively at both ends thereof and a core main body formed between the projections, each of which is configured to project to depart away from the heating rotator in a direction intersecting a direction in which each of the arch core portions extends and a first engaging portion is located at a bottom of each of the projections, the bottom facing an end portion of the core supporting member; and the core supporting member has at the end portion thereof second engaging portions with which first engaging portions are engageable and is disposed opposite to the heating rotator with the arch core portions being between the core supporting member and the heating rotator.

10. The fixing device according to claim 9, wherein the first engaging portion functions as a contact surface coming into contact with a second engaging portion when the arch core portions are attached to the core supporting member.

11. An image forming apparatus comprising:

an image bearing member on a surface of which an electrostatic latent image is formed;

a development unit configured to develop the electrostatic image formed on the surface of the image bearing member as a toner image;

an image transfer portion configured to transfer the toner image formed on the surface of the image bearing member directly or indirectly to a recording medium; and the fixing device according to claim 9.

* * * * *